US011821130B2

(12) United States Patent
Zhang et al.

(10) Patent No.: US 11,821,130 B2
(45) Date of Patent: Nov. 21, 2023

(54) BALANCE ASSEMBLY AND HOUSEHOLD APPLIANCE

(71) Applicants: GUANGDONG MIDEA WHITE HOME APPLIANCE TECHNOLOGY INNOVATION CENTER CO., LTD., Foshan (CN); MIDEA GROUP CO., LTD., Foshan (CN)

(72) Inventors: Su Zhang, Foshan (CN); Yuehui Wang, Foshan (CN); Jinghao Shen, Foshan (CN)

( * ) Notice: Subject to any disclaimer, the term of this patent is extended or adjusted under 35 U.S.C. 154(b) by 0 days.

(21) Appl. No.: 17/787,331

(22) PCT Filed: Dec. 11, 2020

(86) PCT No.: PCT/CN2020/135819

§ 371 (c)(1),
(2) Date: Jun. 19, 2022

(87) PCT Pub. No.: WO2021/135895

PCT Pub. Date: Jul. 8, 2021

(65) Prior Publication Data

US 2023/0038271 A1 Feb. 9, 2023

(30) Foreign Application Priority Data

Dec. 31, 2019 (CN) ..... 201911422166.1
Dec. 31, 2019 (CN) ..... 201922501445.9

(51) Int. Cl.
*D06F 37/22* (2006.01)
*D06F 34/16* (2020.01)

(52) U.S. Cl.
CPC ..... *D06F 37/225* (2013.01); *D06F 34/16* (2020.02)

(58) Field of Classification Search
CPC ..... D06F 37/22; D06F 37/225; D06F 37/24; D06F 37/245; D06F 34/16; D06F 33/48; D06F 33/76; D06F 2103/00
See application file for complete search history.

(56) References Cited

U.S. PATENT DOCUMENTS

2012/0192362 A1 8/2012 Lee et al.
2014/0366589 A1* 12/2014 Park ..... D06F 37/225 68/140

FOREIGN PATENT DOCUMENTS

CN 102101251 A 6/2011
CN 102767065 A 11/2012
(Continued)

OTHER PUBLICATIONS

ISR mailed Mar. 10, 2021 of PCT /CN2020/135819.
(Continued)

*Primary Examiner* — David G Cormier
(74) *Attorney, Agent, or Firm* — KILPATRICK TOWNSEND & STOCKTON, LLP

(57) ABSTRACT

Provided is a balance assembly applied in a household appliance. The balance assembly includes: a balancing body having a chamber defined therein; a balancer movably located in the chamber; a first wireless charging assembly; and an energy storage device located outside the balancer and connected to the first wireless charging assembly. The first wireless charging assembly is configured to receive a charging energy wirelessly transmitted by the household appliance. The energy storage device, the first wireless charging assembly, and the balancing body are mounted within a cavity of the household appliance. The chamber has a first conductive structure provided on an inner wall thereof, and the first conductive structure is electrically connected to the energy storage device. The balancer
(Continued)

includes a second conductive structure movably connected to the first conductive structure.

20 Claims, 13 Drawing Sheets

(56) References Cited

FOREIGN PATENT DOCUMENTS

| | | | |
|---|---|---|---|
| CN | 102782201 | A | 11/2012 |
| CN | 103485126 4 | | 1/2014 |
| CN | 103485129 | A | 1/2014 |
| CN | 103781959 | A | 5/2014 |
| CN | 104233709 | A | 12/2014 |
| CN | 105274781 | A | 1/2016 |
| CN | 211395022 | U | 9/2020 |
| CN | 211395025 | U | 9/2020 |
| CN | 211395035 | U | 9/2020 |
| EP | 3378982 | A1 | 9/2018 |
| JP | H03251294 | A | 11/1991 |
| WO | 2013022164 | A2 | 2/2013 |
| WO | 2013154313 | A1 | 10/2013 |
| WO | 2013183929 | A1 | 12/2013 |

OTHER PUBLICATIONS

Extended European Search Report dated Jan. 4, 2023 regarding EP Application No. 20910331.6.
1st OA & 1st Search dated Feb. 28, 2023 regarding CN Application No. 201911422166.1.

* cited by examiner

BALANCE ASSEMBLY AND HOUSEHOLD APPLIANCE

CROSS-REFERENCES TO RELATED APPLICATIONS

The present disclosure is a national phase application of International Application No. PCT/CN2020/135819, filed on Dec. 11, 2020, which claims priority to Chinese Patent Applications No. 201911422166.1 and 201922501445.9 filed on Dec. 31, 2019 to China National Intellectual Property Administration, the entireties of which are herein incorporated by reference.

FIELD

The present disclosure relates to the field of household appliance technologies, and more particularly, to a balance assembly and a household appliance.

BACKGROUND

In a dehydration stage of a washing machine, a laundry in a washing cavity is unevenly distributed, which may result in an eccentricity. When rotating at high rotation speed, the washing cavity will generate great vibration. In the related art, a balancing body is mounted on the washing cavity, and the balancing body has a balance trolley movably provided therein. By controlling a movement of the balance trolley in the balancing body, the eccentricity of the laundry in the washing cavity is balanced by a gravity and a centripetal force of the balance trolley itself, so that the vibration of the washing cavity tends to be decreased, to reduce noise and vibration of the washing machine.

A circuit of the balancing trolley is connected to a bearing of the washing cavity by a wire, and an electric connection between the circuit of the balancing trolley and a circuit of a control system is implemented by using a brush. However, the use of the brush to realize the electrical connection has problems of insufficient service life of the brush due to fatigue, discontinuous electricity transmission of the brush and a need for a higher sealing structure.

SUMMARY

Embodiments of the present disclosure provide a balance assembly and a household appliance.

An embodiment of the present disclosure provides a balance assembly applied in a household appliance. The balance assembly includes a balancing body having a chamber defined therein; a balancer movably located within the chamber; a first wireless charging assembly; and an energy storage device located outside the balancer and connected to the first wireless charging assembly. The energy storage device, the first wireless charging assembly, and the balancing body are mounted within a cavity of the household appliance. The first wireless charging assembly is configured to receive a charging energy wirelessly transmitted by the household appliance and charge the energy storage device with the charging energy. The chamber includes a first conductive structure provided on an inner wall thereof, and the first conductive structure is electrically connected to the energy storage device. The balancer includes a second conductive structure movably connected to the first conductive structure. The energy storage device may supply power to the balancer by the first conductive structure and the speed regulating structure.

In the balance assembly as described above, the first wireless charging assembly may charge the energy storage device with the charging energy wirelessly transmitted by the household appliance, and the balancer in the balancing body is powered by the energy storage device through the first conductive structure and the speed regulating structure. In this way, the power supply to the energy storage device by a brush can be avoided, and a sealing performance of the balancing body and a reliability of the power supply can be improved.

An embodiment of the present disclosure provides a household appliance including a body, a cavity rotatably connected to the body, a second wireless charging assembly, and the balance assembly according to any one of the embodiments as described above. The energy storage device, the first wireless charging assembly, and the balancing body are mounted within the cavity, and the second wireless charging assembly is mounted within the body.

In the household appliance as described above, the first wireless charging assembly may charge the energy storage device with the charging energy wirelessly transmitted by the second wireless charging assembly, and the balancer in the balancing body is powered by the energy storage device through the first conductive structure and the second conductive structure. In this way, the power supply to the energy storage device by a brush can be avoided, and a sealing performance of the balancing body and a reliability of the power supply can be improved.

Additional embodiments of the present disclosure will be provided at least in part in the following description, or will become apparent at least in part from the following description, or can be learned from practicing of the present disclosure.

BRIEF DESCRIPTION OF THE DRAWINGS

The above embodiments of the present disclosure will become more apparent and more understandable from the following description of embodiments in conjunction with the accompanying drawings, in which.

Figure 1:
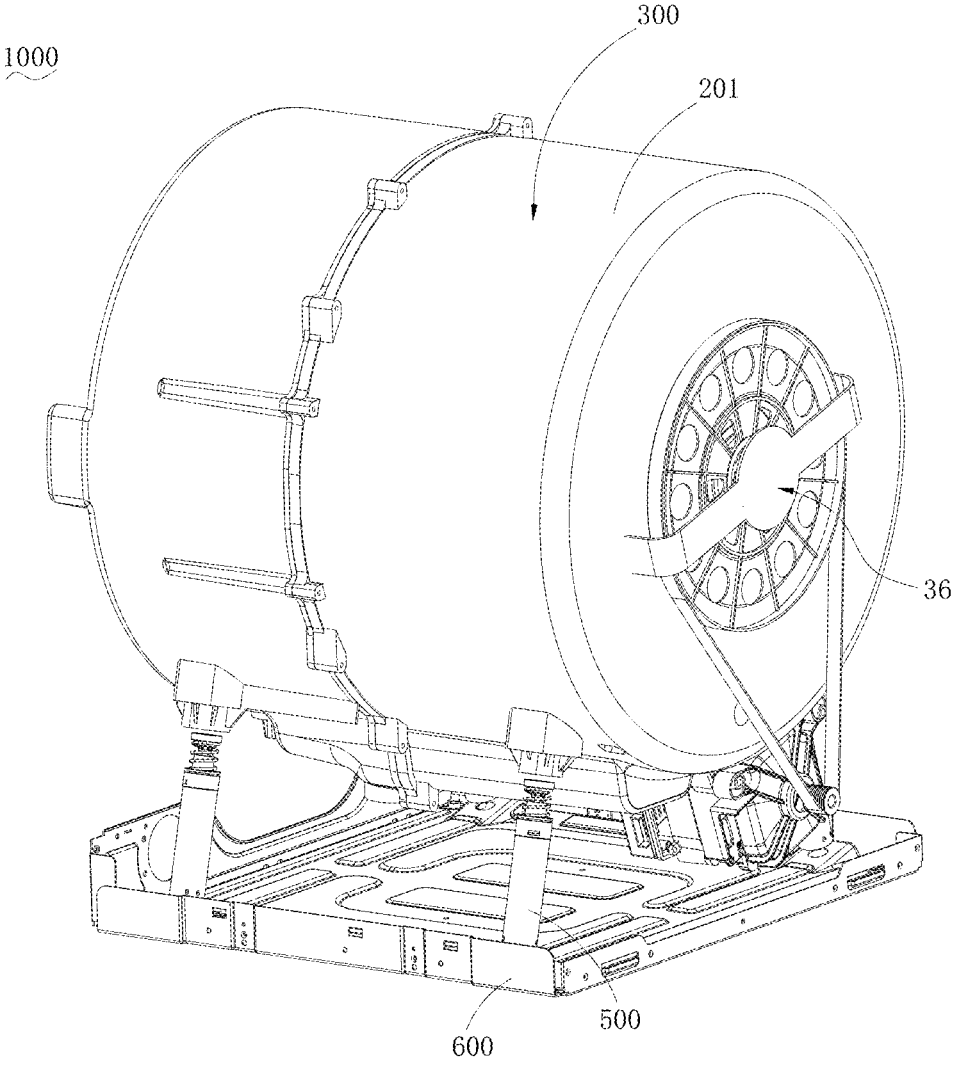
FIG. 1 is a schematic structural view illustrating a household appliance according to an embodiment of the present disclosure.

REFERENCE SIGNS OF MAIN COMPONENTS balance assembly 100;

balancing body 10, first conductive structure 11, first guide rail 112, second guide rail 114, chamber 12, initial position 121, inner wall 122, connection member 14, bearing ring 15, end cap 16, annular base 17;

balancer 20, controller 21, bracket 22, first side surface 222, second side surface 224, connection plate 25, second conductive structure 24, conductive shaft 240, conductive wheel 241, first conductive element 242, connection rod 243, second conductive element 244, wire 245, base 246, elastic member 2462, connection post 247, connection frame 248, mounting slot 2482, control board 26, control compartment 29;

driving assembly 23, driving member 232, output shaft 2322, rotation member 234, gear 2342, tooth 23422, groove 23424, speed regulating structure 236, first-stage transmission structure 2362, worm 23622, worm wheel 23624, second-stage transmission structure 2364, first gear 23642, second gear 23644, housing 238, rotation shaft 231;

bearing structure 27, bearing plate 272, mounting hole 2722, rolling member 274, bearing 2742, spindle 2744, energy storage device 30, first wireless charging assembly 34, receiving coil 342, second wireless charging assembly 36, transmitting coil 362;

identification member 40, displacement detection member 50, correction member 60, correction detection member 70;

household appliance 1000, cavity (washing cavity 200), water-receiving cavity 201, first end 202, second end 204, body 300, main controller 400, vibration damping structure 500, mounting plate 600, fixing frame 700.

DETAILED DESCRIPTION OF THE DISCLOSURE

Embodiments of the present disclosure are described below in detail, examples of the embodiments are shown in accompanying drawings, and throughout the description, the same or similar reference signs represent the same or similar components or the components having the same or similar functions. The embodiments described below with reference to the accompanying drawings are exemplary and merely used to explain the present disclosure, rather than being construed as limitation on the present disclosure.

In the description of the present disclosure, it should be understood that the orientation or position relationship indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", etc., is based on the orientation or position relationship shown in the drawings, and is merely for the convenience of describing the present disclosure and simplifying the description, rather than indicating or implying that the defined device or element must have a specific orientation or must be constructed and operated in a specific orientation. Thus, the orientation or position relationship indicated by these terms cannot be understood as limitations on the present disclosure. In addition, the terms "first" and "second" are only used for purpose of description, and cannot be understood as indicating or implying relative importance or implicitly indicating the number of indicated features. Therefore, the features defined with the terms "first" and "second" may explicitly or implicitly include at least one of the features. In the description of the present disclosure, "plurality" means at least two, unless otherwise specifically defined.

In the present disclosure, unless expressly specified and defined otherwise, the first feature being "on" or "under" the second feature may indicate that the first feature is in direct contact with the second feature, or the first and second features, instead of being in direct contact with each other, are in contact with each other by another feature therebetween. In one embodiment, the first feature being "above" the second feature may indicate that the first feature is directly above or obliquely above the second feature, or simply indicate that a level of the first feature is higher than that of the second feature. The first feature being "below" the second feature may indicate that the first feature is directly below or obliquely below the second feature, or merely indicate that a level of the first feature is less than that of the second feature.

In the description of the present disclosure, it should be noted that, unless otherwise clearly specified and defined, terms such as "installed", "mounted", "connected to", "connected with" and the like should be understood in a broad sense. For example, it may be a fixed connection or a detachable connection or integral connection; it may be a mechanical connection or an electrical connection or a mutual communication; it may be a direct connection or an indirect connection by an intermediate; it may be an internal communication of two components or an interaction relationship between two components. The specific meaning of the above-mentioned terms in the present disclosure can be understood according to specific circumstances.

Various embodiments or examples for implementing different structures of the present disclosure are provided below. In order to simplify the description of the present disclosure, components and arrangements of specific examples are described herein. Of course, these specific examples are merely for the purpose of illustration, and they are not intended to limit the present disclosure. Furthermore, the same reference signs and/or reference letters may appear in different examples of the present disclosure for the purpose of simplicity and clarity, instead of indicating a relationship between different discussed embodiments and/or arrangements. In addition, the present disclosure provides examples of various specific processes and materials.

Figure 19:
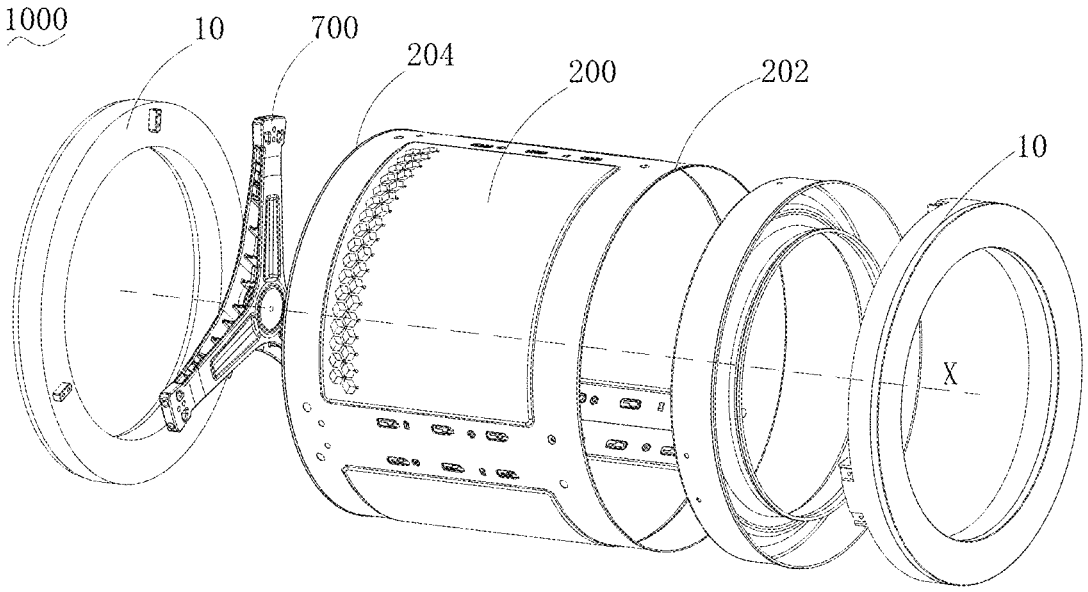
FIG. 19 is a schematic partially exploded view illustrating a cavity and a balancing body according to an embodiment of the present disclosure.

Referring to FIG. 1 to FIG. 4 and in connection with FIG. 19, an embodiment of the present disclosure provides a balance assembly 100 applied in a household appliance 1000. The balance assembly 100 includes: a balancing body 10 having a chamber 12 defined therein; a balancer 20 movably located within the chamber 12; a first wireless charging assembly 34; and an energy storage device 30 located outside the balancer 20 and connected to the first wireless charging assembly 34. The first wireless charging assembly 34 is configured to receive a charging energy wirelessly transmitted by the household appliance 1000 and charge the energy storage device 30 with the charging energy. The energy storage device 30, the first wireless charging assembly 34, and the balancing body 10 are mounted within a cavity 200 of the household appliance 1000. The chamber 12 has a first conductive structure 24 provided on an inner wall 122 thereof. The first conductive structure 24 is electrically connected to the energy storage device 30. The balancer 20 includes a second conductive structure 24 movably connected to the first conductive structure 11. The energy storage device 30 may supply power to the balancer 20 by the first conductive structure 11 and the speed regulating structure 24.

In the above balance assembly 100, the first wireless charging assembly 34 may charge the energy storage device 30 with the charging energy wirelessly transmitted by the household appliance 1000. The balancer 20 in the balancing body 10 is powered by the energy storage device 30 through the first conductive structure 11 and the second conductive structure 24. In this way, the power supply to the energy storage device 30 by a brush can be avoided, and a sealing performance of the balancing body 10 and a reliability of the power supply can be improved. And, the energy storage device 30 is located outside the balancer 20, a weight of the balancer 20 itself can thus be reduced and the balancer 20 is more easily driven. Further, in a case where balancers 20 is provided, balancers 20 can share the energy storage device 30 and the balance assembly 100 can be supplied by a uniform power supply at a lower cost.

In one embodiment, the balance assembly 100 can be applied in the household appliance 1000. The balancing body 10 and energy storage device 30 of the balance assembly 100 may be mounted on the cavity 200 of the household appliance 1000. The household appliance 1000 may be a clothing treatment appliance such as a washing machine (e.g., a drum washing machine), a clothing dryer, or other household appliances 1000 having a rotatable cavity 200. In the embodiment of the present disclosure, the household appliance 1000 includes a body 300, the cavity 200, and the balance assembly 100. The cavity 200 is movably connected to the body 300, and has a rotation axis. The balancing body 10 is mounted within the cavity 200. The household appliance 1000 includes a second wireless charging assembly 36 mounted within the body 300. The household appliance 1000 also includes a main controller 400. The balancer 20 also includes a controller 21. The main controller 400 is in communication with the controller 21 to transmit a current status signal and a movement signal of the balancer 20, etc. The main controller 400 may be in communication with the controller 21 in a wired manner or in a wireless manner. The cavity 200 of the household appliance 1000 rotates at a high rotation speed during operation, which may result in an uneven load distribution and eccentricity in the cavity 200. As a result, a greater vibration may be generated in the household appliance 1000. The balancing body 10 is fixed to the cavity 200 and rotates together with the cavity 200. Therefore, an eccentric mass of the cavity 200 as it rotates can be offset by controlling a movement of the balancer 20 in the chamber 12 of the balancing body 10, to reduce the vibration of the household appliance 1000.

The energy storage device 30 is located outside of the balancer 20. It should be understood that the energy storage device 30 is not mounted on the balancer 20. The energy storage device 30 may be fixed to some other physical locations outside the balancer 20, such as onto the cavity 200.

In an example of the present disclosure, the main controller 400 is in wireless communication with the controller 21. In one embodiment, the main controller 400 may include a first wireless communication module and a wireless gateway. The controller 21 may include a second wireless communication module. The second wireless communication module, the first wireless communication module, and the wireless gateway are configured to form a wireless communication network. Each of the first wireless communication module and the second wireless communication module may be a WiFi module, a Bluetooth module, a NRF module, a ZigBee module, or a mobile communication module (e.g., a 4G module, a 5G module, etc.). In this way, the first wireless communication module and the second wireless communication module have options and are highly replaceable. A selection of the wireless gateway is adapted to types of the first wireless communication module and the second wireless communication module.

It should be understood that the home appliance 1000 includes the second wireless charging assembly 36. In connection with FIG. 20, the first wireless charging assembly 34 includes a receiving coil 342, and the second wireless charging assembly 36 includes a transmitting coil 362. The receiving coil 342 and the transmitting coil 361 is spaced apart from each other and arranged opposite to each other. The transmitting coil 362 may transmit the charging energy to the receiving coil 342, and the receiving coil 342 may charge the energy storage device 30 with the received charging energy. The energy storage device 30 may be electrically connected to the first conductive structure 11, so that the balancer 20 can receive power from the energy storage device 30 via the first conductive structure 11. The receiving coil 342 and the transmitting coil 361 are arranged coaxially along a rotation axis X. In this way, the cavity 200 rotates with less impact on an electrical energy transmission efficiency of the receiving coil 342 and the transmitting coil 362.

Figure 2:
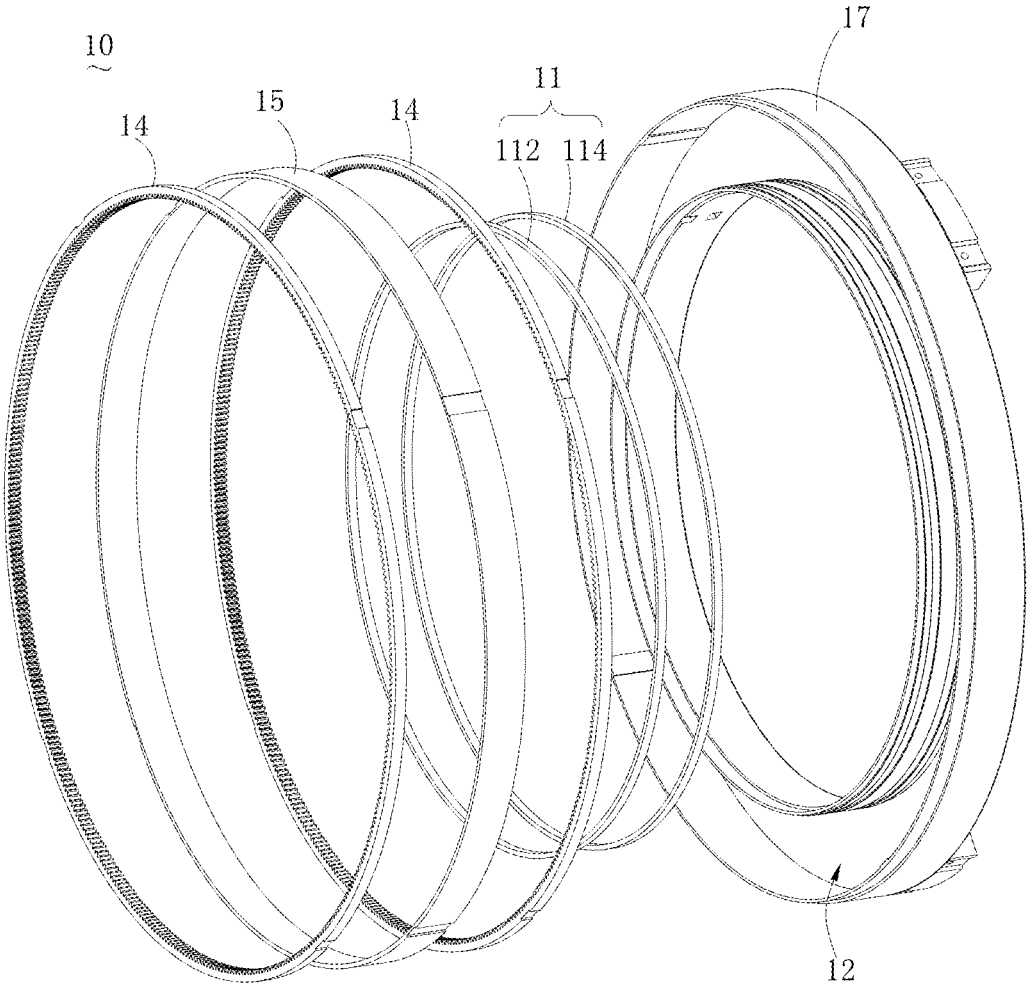
FIG. 2 is a schematic exploded view illustrating a balancing body according to an embodiment of the present disclosure.
Figure 3:
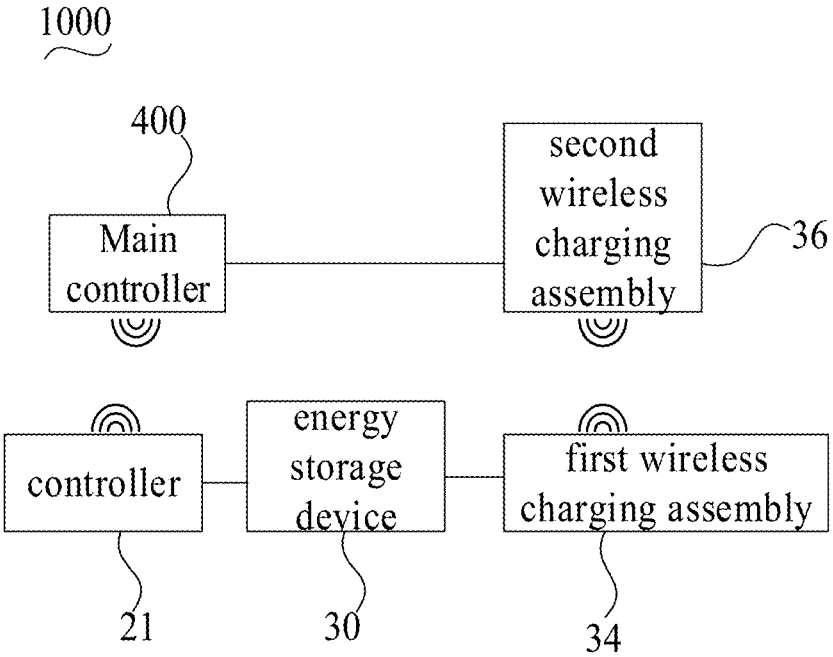
FIG. 3 is a schematic modular view illustrating a household appliance according to an embodiment of the present disclosure.
Figure 5:
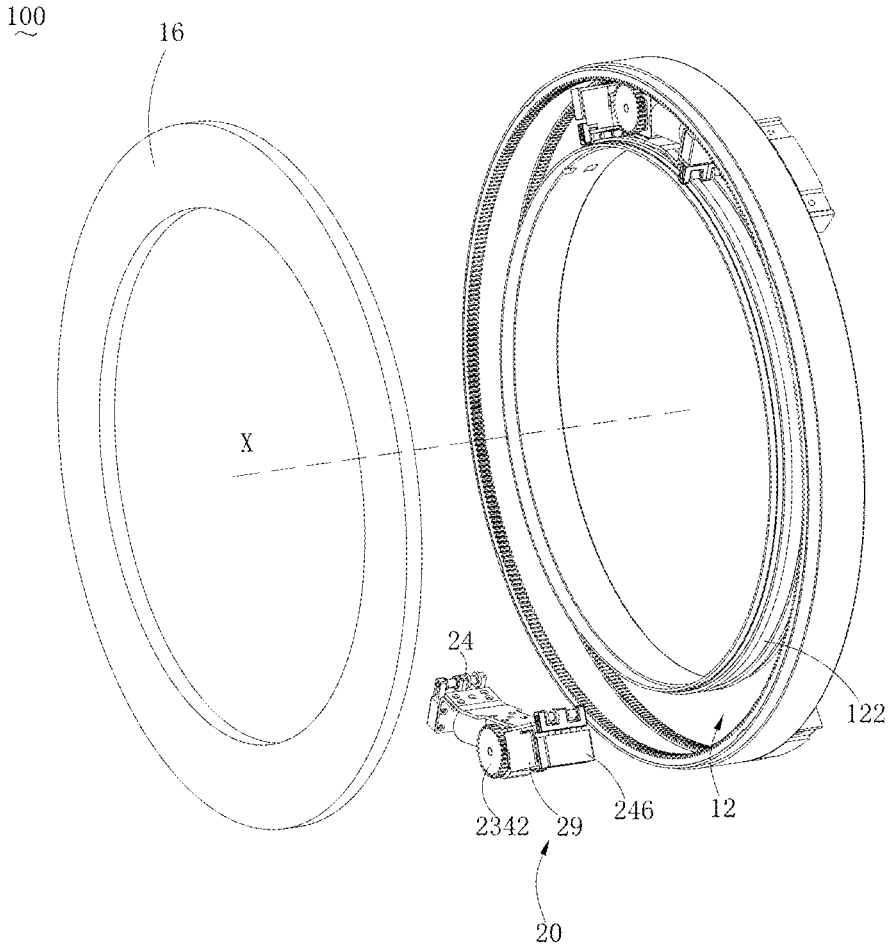
FIG. 5 is a schematic exploded view illustrating a balance assembly according to an embodiment of the present disclosure.

In the illustrated embodiment, the balancing body 10 is in an annular shape. It will be understood that in other embodiments, the balancing body 10 may be in other shapes, such as a flat plate shape, which is not specifically limited herein. Referring to FIG. 2 and FIG. 5, in some embodiments, the balancing body 10 includes a bearing ring 15, an end cap 16, an annular connection member 14, and an annular base 17. The chamber 12 is formed within the annular base 17. The end cap 16 is connected to the annular base 17 and seals the chamber 12. The bearing ring 15 is mounted on an inner wall 122 of the chamber 12. Two connection members 14 may be provided, and mounted on both sides of the bearing ring 15, respectively. Due to the annular shape of the balancing body 10, it is possible to allow a circumferential movement of the balancer 20 within the chamber 12 of the balancing body 10.

Figure 4:
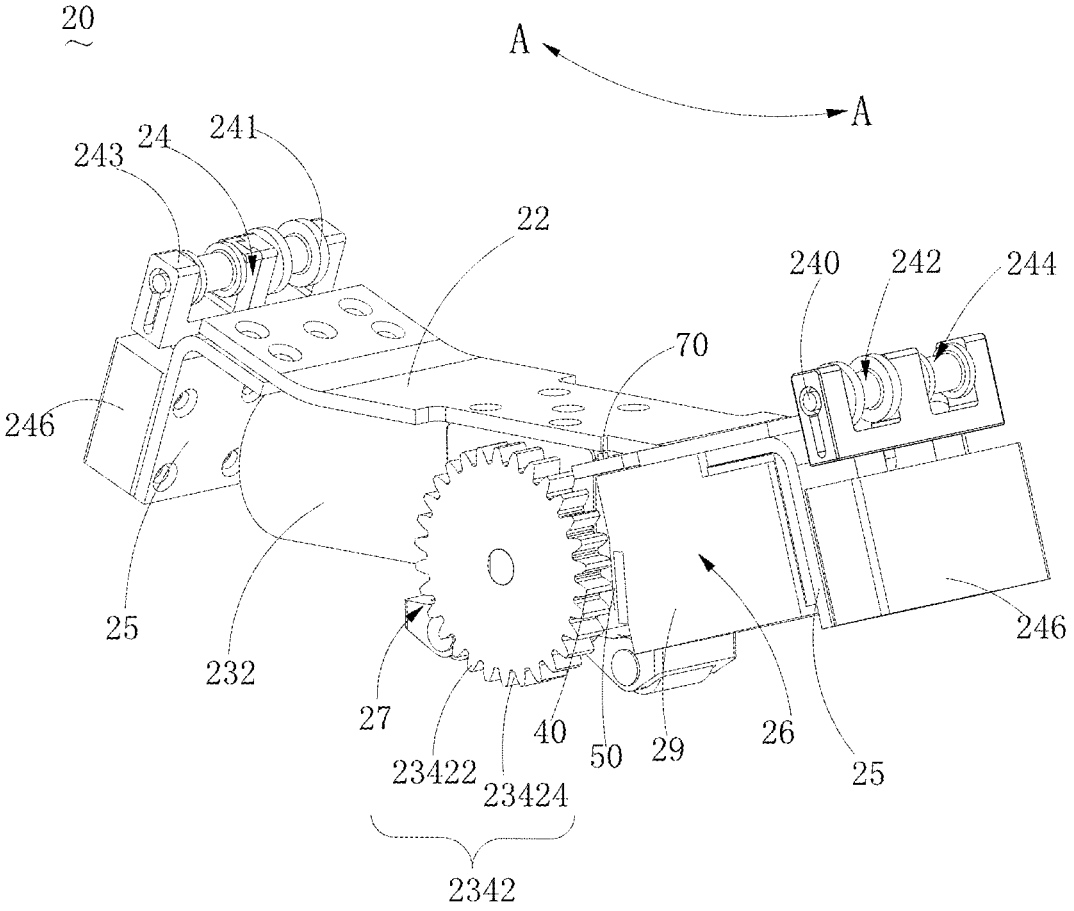
FIG. 4 is a schematic perspective view illustrating a balancer according to an embodiment of the present disclosure.
Figure 6:
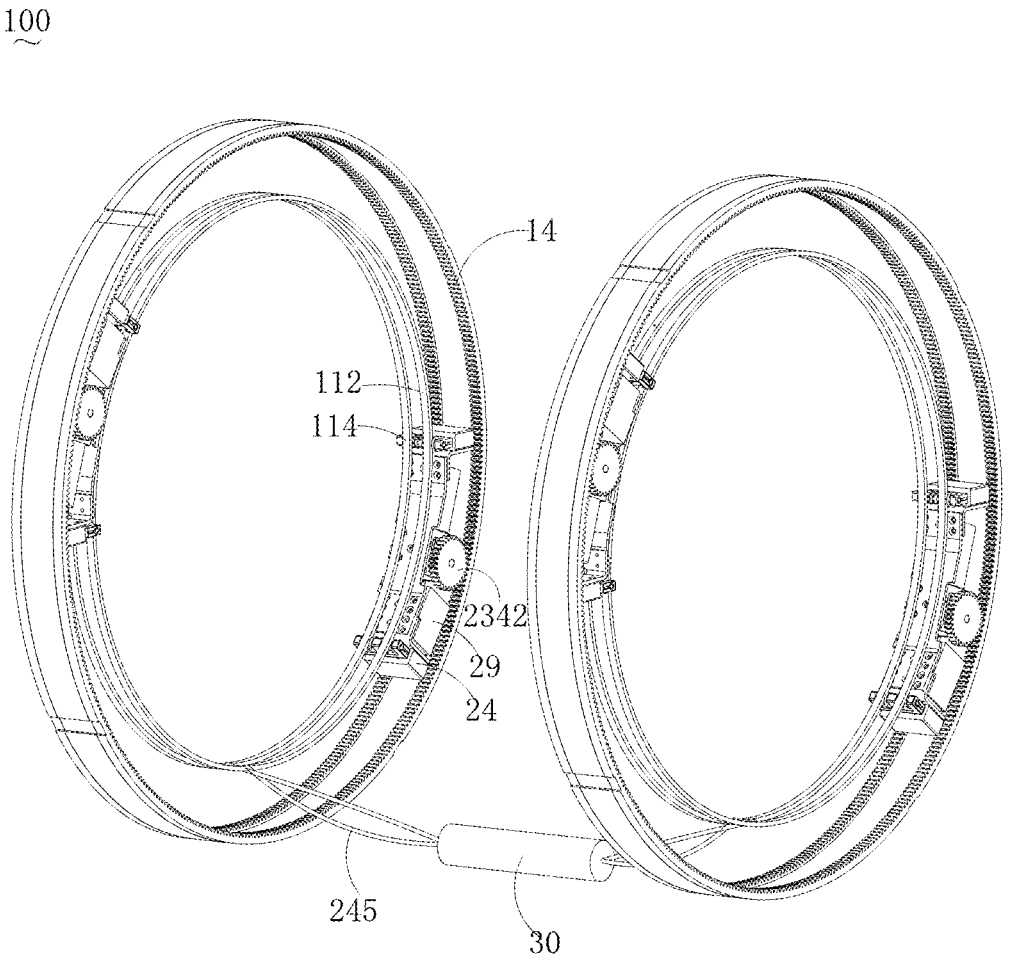
FIG. 6 is a schematic partial structural view illustrating the balance assembly according to an embodiment of the present disclosure.

Referring to FIG. 4 to FIG. 6, in some embodiments, the balancer 20 includes a bracket 22 on which the second conductive structure 24 is mounted. In addition, the connection between the first conductive structure 11 and the second conductive structure 24 may also serve to guide the movement of the balancer 20. By the guidance of the first conductive structure 11 and the second conductive structure 24, the balancer 20 can stably move in the chamber 12 at a high speed, to prevent the balancer 20 from being separated from the balancing body 10.

In one embodiment, referring to FIG. 4, in a length direction A-A of the balancer 20, two second conductive structures 24 may be provided, and the two second conductive structures 24 are mounted at both ends of the bracket 22, respectively. The second conductive structures 24 may be mounted on the bracket 22 by connection plates 25. In other embodiments, one or more second conductive structures 24 may be provided, which is not specifically limited herein. Further, referring to FIG. 5 and FIG. 6, the movement of the balancer 20 is guided by the first conductive structure 11 and the second conductive structure 24 together. The second conductive structure 24 is mounted at both ends of the balancer 20, and the first conductive structure 11 is mounted on the inner wall 122 of the chamber 12. The first conductive structure 11 and the second conductive structure 24 cooperate with each other to guide the movement of the balancer 20 together. It should be understood that, the balancer 20 may generate a shake when moving within the chamber 12, and may cause the balancer 20 to deviate from its movement trajectory when moving at the high speed, to affect the movement of the balancer 20. The first conductive structure 11 and the second conductive structure 24, on the one hand can conduct electricity, and on the one hand can guide the balancer 20 to move when attaching on the inner wall 122 of the chamber 12. Meanwhile, a stability of the balancer 20 can be increased.

In the embodiment of the present disclosure, the bracket 22 may be made of a metal material such as a thick stainless-steel plate, for fixing the second conductive structure 24 and other components of the balancer 20. In this way, it is possible to avoid the components of the balancer 20 from loosening during an operation of the balancer 20, and the bracket 22 would not be deformed throughout the operation of the balancer 20.

Figure 7:
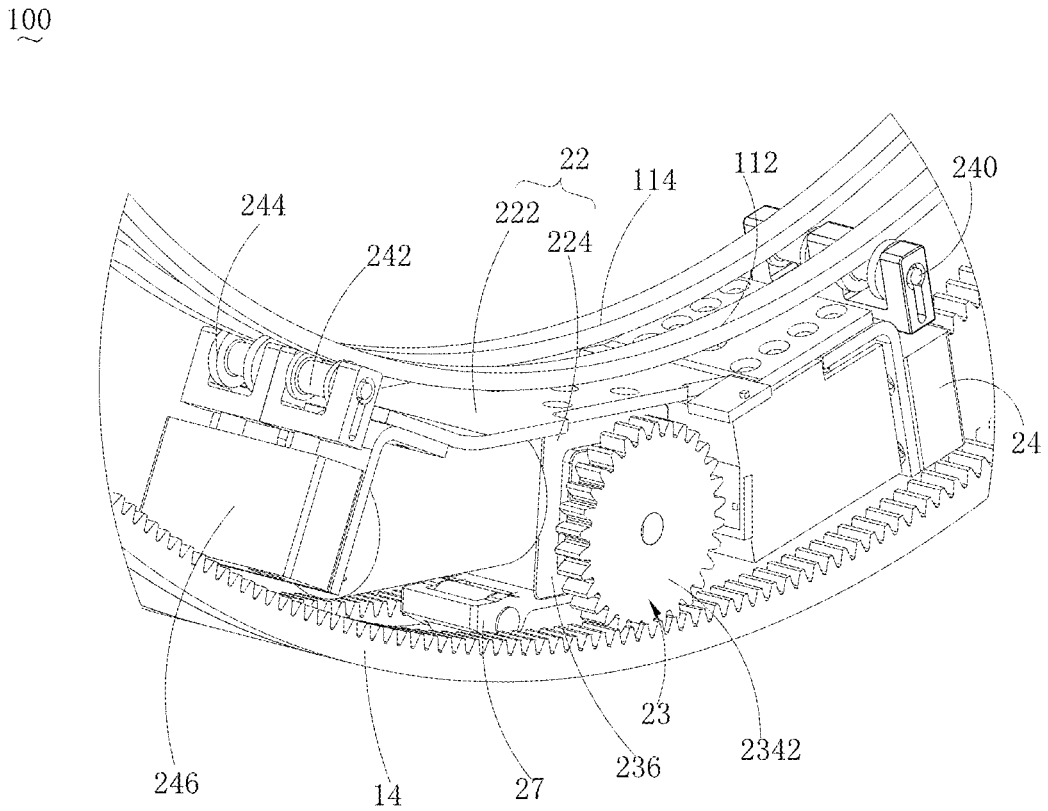
FIG. 7 is a schematic partial structural view illustrating the balance assembly according to another embodiment of the present disclosure.
Figure 8:
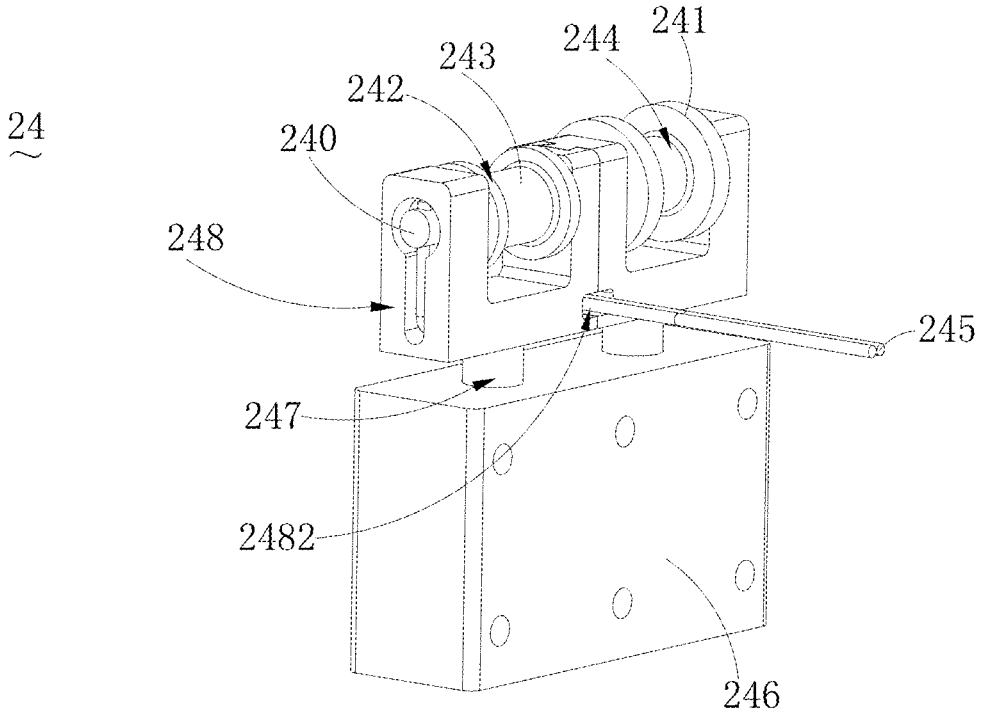
FIG. 8 is a schematic structural view illustrating a second conductive structure according to an embodiment of the present disclosure.

Referring to FIG. 6 to FIG. 8 and in connection with FIG. 4, in some embodiments, the balancer 20 includes a control board 26. The second conductive structure 24 includes a first conductive element 242 and a second conductive element 244, and a first conductive structure 11 includes a first guide rail 112 and a second guide rail 114. The first conductive element 242 is connected to the first guide rail 112, and the second conductive element 244 is connected to the second guide rail 114. The first conductive element 242 and the second conductive element 244 are electrically connected to the control board 26, respectively. In this way, the second conductive structure 24 can receive power from the energy storage device 30 by the first conductive structure 11 and transmit the power to the control board 26, and the control power can supply the electrical energy to the load of the balancer 20.

In one embodiment, the second conductive structure 24 includes a conductive shaft 240 (e.g., a copper shaft). The conductive shaft 240 is stationary. Two conductive shafts 240 may be provided, and the two conductive shafts 240 pass through the first conductive element 242 and the second conductive element 244, respectively. The first conductive element 242 and the second conductive element 244 may each rotate around the conductive shaft 240. A wire 245 may be electrically connected the conductive shaft 240 and the energy storage device 30, and the electrical energy is transmitted from the conductive shaft 240 and the wire 245 to the energy storage device 30.

In one embodiment, the energy storage device 30 may include a rechargeable battery. A positive electrode of the rechargeable battery may be connected to the first guide rail 112 via the wire 245, the conductive shaft 240, and the first conductive element 242. A negative electrode of the rechargeable battery may be connected to the second guide rail 114 via the wire 245, the conductive shaft 240, and the second conductive element 244. An electrical energy of the battery is transmitted from the first guide rail 112 and the second guide rail 114 to the balancer via the first guide rail 112 and the second guide rail 114. Since the first conductive element 242 is connected to the first guide rail 112 and the second conductive element 244 is connected to the second guide rail 114, according to a principle that metals have electrical conductivity, the first conductive element 242 can receive power via the first guide rail 112, and the second conductive element 244 can receive power via the second guide rail 114. And then, the first conductive element 242 and the second conductive element 244 transmit the electrical energy to the conductive shaft 240 and the wire 245, respectively, and then to the control board 26 of the balancer 20, which in turn may provide the electrical energy to a load of the balancer 20. In this way, the control board 26 of the balancer 20 can receive power from the battery via the first conductive structure 11 and the second conductive structure 24.

It should be appreciated that, each of the first guide rail 112 and the second guide rail 114 may be an annular guide rail provided on the inner wall 122 of the chamber 12. The first guide rail 112 and the second guide rail 114 are electrically conductive, for example made of copper. The first conductive element 242 and the second conductive element 244 may also be made of copper.

In other embodiments, the first guide rail 112 and the second guide rail 114 as well as the first conductive element 242 and the second conductive element 244 may also be made of other conductive materials, which will not be limited herein. The balancer 20 may include a control compartment 29 in which the control board 26 is placed. The controller 21 of the balancer 20 is disposed on the control board 26.

Referring to FIG. 6 and FIG. 7, in some embodiments, each of the first conductive element 242 and the second conductive element 244 includes a conductive wheel 241. The conductive wheel 241 of the first conductive element 242 is movably connected to the first guide rail 112, and the conductive wheel 241 of the second conductive element 244 is movably connected to the second guide rail 114. Thus, it is advantageous to reduce a friction between the first conductive structure 11 and the second conductive structure 24 when the balancer 20 is moving.

In one embodiment, the conductive wheel 241 may be a roller and may be circular in shape, and the conductive wheel 241 may be rolled and moved on the guide rails. In this way, during the movement of the balancer 20, less friction force would be generated between the first conductive structure 11 and the second conductive structure 24, which reduces a resistance during the movement of the balancer 20. Thus, it is beneficial to reduce the power of the balancer 20 and provide the energy storage device 30 with a longer power supply time.

Figure 9:
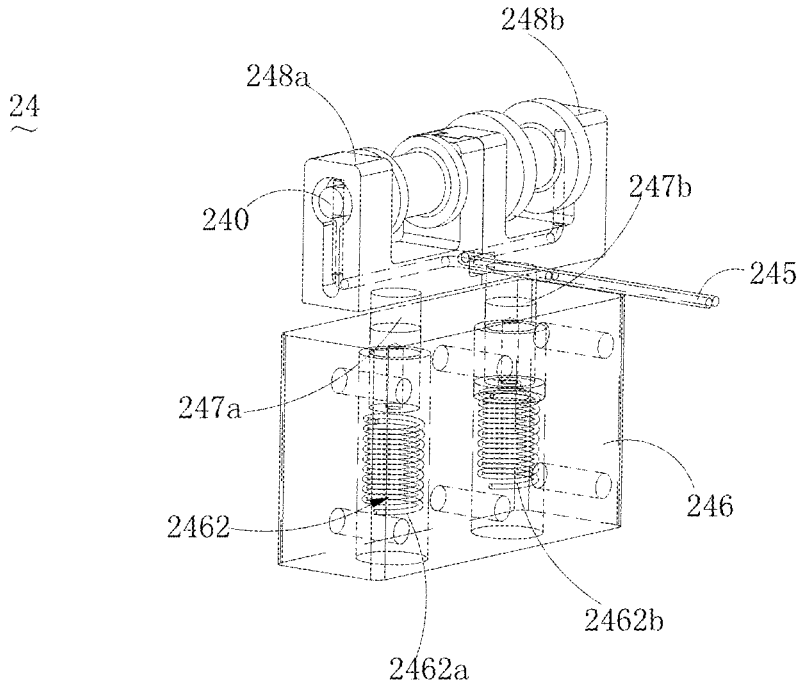
FIG. 9 is a schematic internal structural view illustrating the second conductive structure according to an embodiment of the present disclosure.

Referring to FIG. 8 to FIG. 9, in some embodiments, each of the first conductive element 242 and the second conductive element 244 includes two conductive wheels 241 and a connection rod 243. The two conductive wheels 241 are connected to each other by the connection rod 243. The first guide rail 112 is partially located within a space between the two conductive wheels 241 of the first conductive element 242, and the second guide rail 114 is partially located within a space between the two conductive wheels 241 of the second conductive element 244. In this way, the two conductive wheels 241 of each conductive element can clamp the rails to further ensure the stable movement of the balancer 20.

In one embodiment, the guide rail includes two opposite side surfaces. The two conductive wheels 241 are connected to each other by the connection rod 243 to form an H-shaped conductive element. The conductive wheels 241 are slidably or rollably connected to the side surfaces of the guide rail. The H-shaped conductive element can clamp the guide rails to further ensure the stable movement of the balancer 20.

In the illustrated embodiment, the conductive wheels 241 may roll on the rails. The two conductive wheels 241 of the first conductive element 242 may clamp the first guide rail 112. The two conductive wheels 241 of the second conductive element 244 may clamp the second guide rail 114. In other embodiments, the first conductive structure 11 and the second conductive structure 24 may be connected to each other by embedding or engagement, and can also provide guiding and electricity conduction, which will not be limited herein.

In addition, the two conductive wheels 241 may be rotatably connected to the connection rod 243, for example by a bearing. In other embodiments, the connection rod 243 may be fixedly connected to the conductive wheels 241. A fixed connection may be implemented through metal welding, screw connection, or buckle connection, which will not be specifically limited herein. The conductive shaft 240 passes through the conductive wheels 241 and the connection rod 243.

More In one embodiment, in the illustrated embodiment, two second conductive structures 24 are provided, and the two conductive structures 24 are mounted at both ends of the balancer 20. Each of the second conductive structure 24 includes the first conductive element 242 and the second conductive element 244 arranged side by side. Thus, a reliability of the connection between the second conductive structure 24 and the first conductive structure 22 can be increased.

In some embodiments, referring to FIG. 8 and FIG. 9, the conductive wheels 241 of the first conductive element 242 are elastically abutted against the first guide rail 112, and the conductive wheels 241 of the second conductive element 244 are elastically abutted against the second guide rail 114. In this way, it is possible to prevent the balancer 20 from shaking during its movement.

In one embodiment, the conductive wheels 241 of the first conductive element 242 and the first guide rail 112 will be described as an example. In a case where the conductive wheels 241 of the first conductive element 242 are elastically abutted against the first guide rail 112, when a great force is applied between the conductive wheels 241 of the first conductive element 242 and the first guide rail 112, a force generated by the elastic abutment between the conductive wheels 241 of the first conductive element 242 and the first guide rail 112 drives the conductive wheel 241 of the first conductive element 242 to move away from the first guide rail 112, and to damp the force between the conductive wheels 241 of the first conductive element 242 and the first guide rail 112. Such a force may also be generated between the conductive wheels 241 of the second conductive element 244 and the second rail 114. In this way, the force between the second conductive structure 24 and the first conductive structure 11 can be reduced to prevent the balancer 20 from shaking during its movement.

Referring to FIG. 8 and FIG. 9, in some embodiments, the second conductive structure 24 includes a base 246 and a connection frame 248. The connection frame 248 is movably connected to the base 246. The first conductive element 242 and the second conductive element 244 are mounted on the connection frame 248. In this way, during the movement of the balancer 20, by means of the movable connection of the connection frame 248 to the base 246, the conductive wheels 241 of the first conductive element 242 can be elastically abutted against the base 246, and the conductive wheels 241 of the conductive element 242 can be elastically abutted against the first guide rail 112, so that the balancer 20 can move stably.

In one embodiment, referring to FIG. 8 and FIG. 9, the base 246 has an elastic member 2462 provided therein. The elastic member 2462 is connected to the connection frame 248, and configured to provide the connection frame 248 with a force for elastically abutting the conductive wheels 241 of the first conductive element 242 against the first guide rail 112 and for elastically abutting the conductive wheels 241 of the second conductive element 244 against the second guide rail 114. In this way, the force provided by the elastic member 2462 allows the conductive wheels 241 to be elastically abutted against the guide rail, which in turn ensures that the balancer 20 can move steadily at any rotation speed.

It should be understood that the connection frame 248 may be separated or integrated type. In the embodiment, the connection frame 248 includes a first connection frame **248*a* and a second connection frame 248*b*. The first conductive element 242 and the second conductive element 244 may be mounted to the first connection frame 248*a* and second connection frame 248*b*, respectively. The connection rod 243 of the first conductive element 242 is rotatably connected to the first connection frame 248*a*, and the connection rod 243 of the second conductive element 244 is rotatably connected to the second connection frame 248*b*. The first connection frame 248*a* and the second connection frame 248*b* have a mounting slot 2482 for the wire 245 to pass through. The elastic member 2462 includes a first elastic member 2462*a* and a second elastic member 2462*b*. The first elastic member 2462*a* is connected to the base 246 and the first connection frame 248*a*. The second elastic member 2462*b* is connected to the base 246 and the second connection frame 248*b***.

During the movement of the balancer 20, the first connection frame **248*a* and the second connection frame 248*b* tightly connect the first conductive element 242 to the first guide rail 112 by the first elastic member 2462*a* and tightly connect the second conductive element 244 to the second guide rail 114 by the second elastic member 2462*b*. Thus, risks of a poor contact between the first conductive element 242 and the first guide rail 112 and a poor contact between the second conductive element 244 and the second guide rail 114** due to assembly errors and manufacturing errors can be avoided.

Further, referring to FIG. 8 and FIG. 9, the base 246 has a blind hole defined therein. The blind hole is configured to receive an elastic member 2462. A connection post 247 is located below the connection frame 248. The elastic member 2462 is connected to the connection post 247 at one end thereof and is abutted against a bottom wall of the blind hole at the other end thereof. The elastic member 2462 may be connected to the connection frame 248 by the connection post 247. The connection post 247 may include a first connection post 247*a* by which the first connection frame 248*a* is connected to the first elastic member 2462*a* connected and a second connection post 247*b* by which the second connection frame 248*a* is connected to the second elastic member 2462*b*. In the embodiment of the present disclosure, each of the second conductive structures 24 may include two elastic members 2462 and the base 246 may be subjected to a greater force. In other embodiments, each of the second conductive structures 24 may include one, or three, or other numbers of elastic members 2462, which is not specifically limited herein. The elastic member 2462 may be a spring such as a coil spring, a leaf spring, a torsion bar spring, a gas spring, a rubber spring or the like, which is not specifically limited herein.

Figure 10:
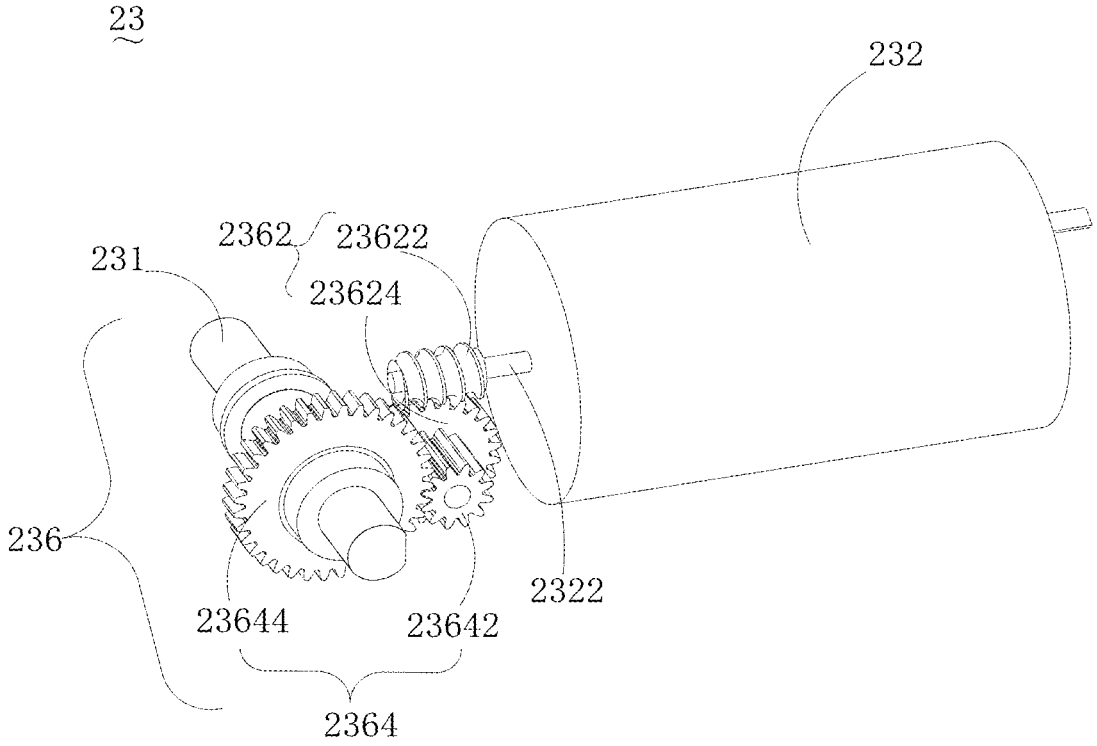
FIG. 10 is a schematic structural view illustrating a speed regulating structure according to an embodiment of the present disclosure.
Figure 11:
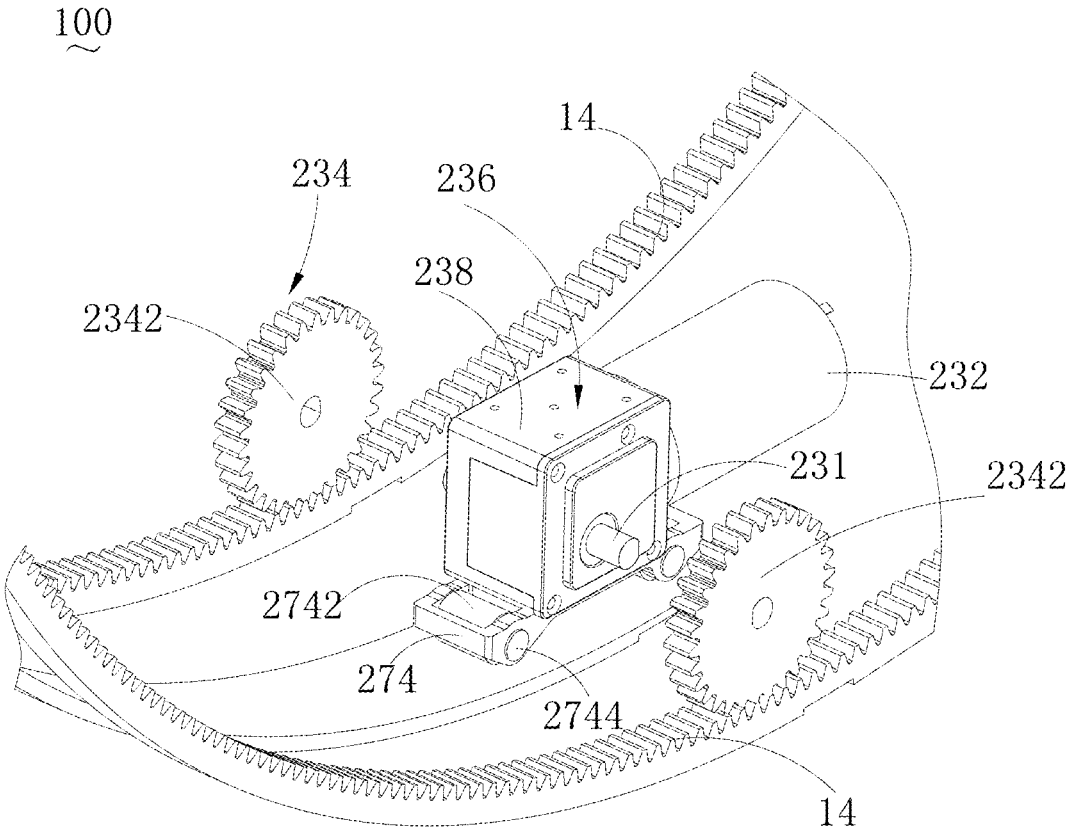
FIG. 11 is another schematic exploded view illustrating the balance assembly according to an embodiment of the present disclosure.

In some embodiment, referring to FIG. 7, FIG. 10, and FIG. 11, the balancer 20 includes a driving assembly 23. The driving assembly 23 includes a driving member 232 and a rotation member 234. The driving member 232 is connected to the rotation member 234 and the control board 26. The control board 26 is configured to control the driving member 232 to drive the rotation member 234 to rotate and to drive the balancer 20 to move in the chamber 12. In this way, the driving member 232 can receive power from the battery by the control board 26. The balancer 20 is driven by the driving assembly 23 to move, so that a position of the balancer 20 within the chamber 12 can be changed, to reduce the vibration of the household appliance 1000.

In one embodiment, the control board 26 of the balancer 20 is connected to the energy storage device 30 by the first conductive structure 11 and the second conductive structure 24. The driving member 232 is connected to the control board 26. Thus, the control board 26 may control a voltage of the driving member 232 to change a state of the driving member 232. The driving member 232 may include a motor to drive the rotation member 234 to rotate, which in turn drives the balancer 20 to move within the chamber 12. In this way, a rapid reduction or an offset of the eccentric mass of the cavity 200 can be realized by the balancer 20, to reduce the vibration of the household appliance 1000. The balancer 20 can be controlled to move or stop the movement in a clockwise or counterclockwise direction by controlling the motor to perform a forward or reverse rotation or stop the rotation.

In some embodiments, referring to FIG. 4 and FIG. 11, the chamber 12 has an annular connection member 14 provided therein. The annular connection member 14 has a tooth portion provided on an inner side thereof. The rotation member 234 includes a gear 2342 engaged with the tooth portion. In this way, the movement of the balancer 20 is driven by the engagement of the gear 2342 with a gear ring, which prevents the balancer 20 from slipping during its movement and ensures the stability of the movement of the balancer 20.

In one embodiment, the chamber 12 includes the inner wall 122. The inner wall 122 has a bearing ring 15. The bearing ring 15 has a connection member 14 provided on an inner side thereof. A modulus of the tooth portion is 1 or 1.25. The gear 2342 of the rotation member 234 is engaged with the tooth portion to rotate. Thus, the balancer 20 can be driven to move relative to the tooth portion while the gear 2342 is rotating. It will be appreciated that in other embodiments, the bearing ring 15 may be omitted, and the connection member 14 may be disposed directly on the inner wall 122 of the chamber 12.

In some embodiments, refer to FIG. 7, FIG. 10, and FIG. 11, the driving assembly 23 includes a speed regulating structure 236 be connected to the driving member 232 and the rotation member 234. Thus, a movement speed of the balancer 20 on the one hand and a movement direction of the balancer 20 on the other hand can be controlled by the speed regulating structure 236.

It should be appreciated that the bracket 22 includes a first side surface 222 and a second side surface 224 opposite to each other. The first side surface 222 faces towards the rotation axis X of the cavity 200. The speed regulating structure 236 is mounted on the second side surface 224 of the bracket 22. The speed regulating structure 236 may include a housing 238 and an adjustment assembly disposed within the housing 238. The housing 238 may be made of a solid thick steel plate which is not easily deformed, and the whole housing 238 has a cuboid shape. In other embodiments, the housing 238 may also be of other shapes such as a cube, a prism, or a cylinder. In the illustrated embodiment, the inner wall 122 has two connection members 14 provided thereon, and the rotation member 234 includes two gears 2342 located on both sides of the housing 238 and engaged with the two connection members 14, respectively. The speed regulating structure 236 can adjust a speed at which the driving member 232 drives the rotation member 234 to rotate, to adjust the movement speed of the balancer 20.

Further, referring to FIG. 10, the speed regulating structure 236 includes a first-stage transmission structure 2362 and a second-stage transmission structure 2364. The first-stage transmission structure 2362 is connected to an output shaft 2322 of the driving member 232, and the second-stage transmission structure 2364 is connected the first-stage transmission structure 2362 and the rotation member 234. In this way, a speed reduction ratio of the balancer 20 can be achieved by the two-stage transmission structure.

In one embodiment, the first-stage transmission structure 2362 includes a worm 23622 and a worm wheel 23624. The second-stage transmission structure 2364 includes a first gear 23642 and a second gear 23644. The worm 23622 is connected to the output shaft 2322 of the driving member 232 and the worm wheel 23624, and the worm wheel 23624 is fixedly connected to the first gear 23642. The first gear 23642 is engaged with the second gear 23644. Each of the first gear 23642 and the second gear 23644 has a modulus of 0.5 and a gear ratio of 1:3. The second gear 23644 is connected to the rotation member 234. In this way, the two-stage transmission can be realized. The worm wheel 23624 and worm 23622 also serve as a limiting function. In addition, the balancer 20 can be stably maintained in the balancing body 10 when the driving member 232 is not operated. In one example, the speed reduction ratio of the balancer 20 may have a speed reduction ratio more than 75 by the two-stage transmission.

It will be appreciated that the first gear 23642 is fixedly connected to the worm wheel 23624, and the second gear 23644 is engaged with the first gear 23642. Referring to FIG. 7, the second gear 23644 are connected to a rotation shaft 231 at opposite sides thereof, and the rotation shaft 231 is connected to the rotation member 234 to realize a synchronous rotation. During an operation of the driving member 232, firstly, the driving member 232 drives the worm 23622 to rotate by the output shaft 2322, and then the worm 23622 drives the worm wheel 23624 engaged with the worm 23622 to rotate, and to realize a first-stage transmission. The worm wheel 23624 further drives the first gear 23642, and then the first gear 23642 drives the second gear 23644, and to realize a second-stage transmission. The second gear 23644 drives the rotation member 234 to rotate synchronously by the rotation shaft 231, thus driving the balancer 20 to move within the chamber 12. The rotation shaft 231 may be a cylindrical shaft or a non-cylindrical shaft. In the illustrated embodiment, the rotation shaft 231 is a D-shaped shaft.

In some embodiments, referring to FIG. 4, FIG. 6, and FIG. 8, the balancer 20 includes a bearing structure 27. The driving assembly 23 is disposed on the bearing structure 27. The bearing structure 27 is in contact with the inner wall 122 of the chamber 12 and is configured to move along the inner wall 122 of the chamber 12 during the movement of the balancer 20 to bear a centrifugal force generated when the balancer 20 moves within the chamber 12. In this way, the bearing structure 27 can bear the centrifugal force of the balancer 20 in a circumferential movement of the cavity 200, to ensure that the balancer 20 moves properly.

It should be understood that the bearing structure 27 is entirely made of a metal material, which is solid and not easily deformed, and can carry the whole driving assembly 23 stably to ensure a normal operation of the driving assembly 23. During the movement of the balancer 20, the bearing structure 27 moves along the inner wall 122 of the chamber 12, and bears the centrifugal force of the balancer 20 in the circumferential movement of the cavity 200 through the contact with the inner wall 122 of the chamber 12. In the embodiment, the bearing structure 27 is able to ensure that the balancer 20 can move normally even when a rotating speed of the cavity 200 is greater than or equal to 800 rpm.

Figure 12:
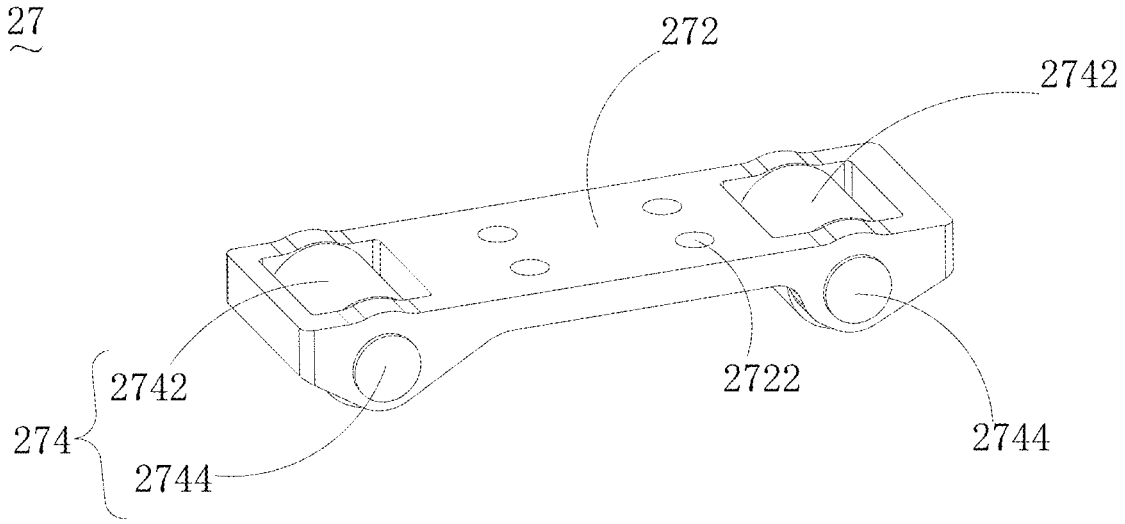
FIG. 12 is a schematic structural view illustrating a bearing structure according to an embodiment of the present disclosure.

Further, referring to FIG. 12, the bearing structure 27 includes a bearing plate 272 and a rolling member 274. The rolling member 274 is rotatably connected to the bearing plate 272 and in contact with the inner wall 122 of the chamber 12, and the driving assembly 23 is mounted on the bearing plate 272.

It is understood that the bearing plate 272 may be made of a thick stainless-steel plate, and the bearing plate 272 has two rolling members 274 provided at both ends thereof, respectively. The rolling member 274 include a bearing 2742 and a spindle 2744 passed through the bearing 2742. The spindle 2744 is fixedly connected to the bearing plate 272 by means of metal welding, adhesive bonding, screw connection, or snap connection, which is not limited herein. During driving the rotation member 234 by the driving member 232 to drive the balancer 20 to move, the bearing 2742 moves in a circumferential motion with respect to the spindle 2744, so that the bearing structure 27 slides within the chamber 12.

Further, the bearing plate 272 also has mounting holes 2722 defined thereon. Mounting holes 2722 is configured to mount the bearing structure 27 to the balancer 20. For example, fasteners may pass through mounting holes 2722 to be connected to the housing and to mount the bearing structure 27 to the housing. The mounting holes 2722 may have a circular, rectangular, oval shape or the like.

Figure 13:
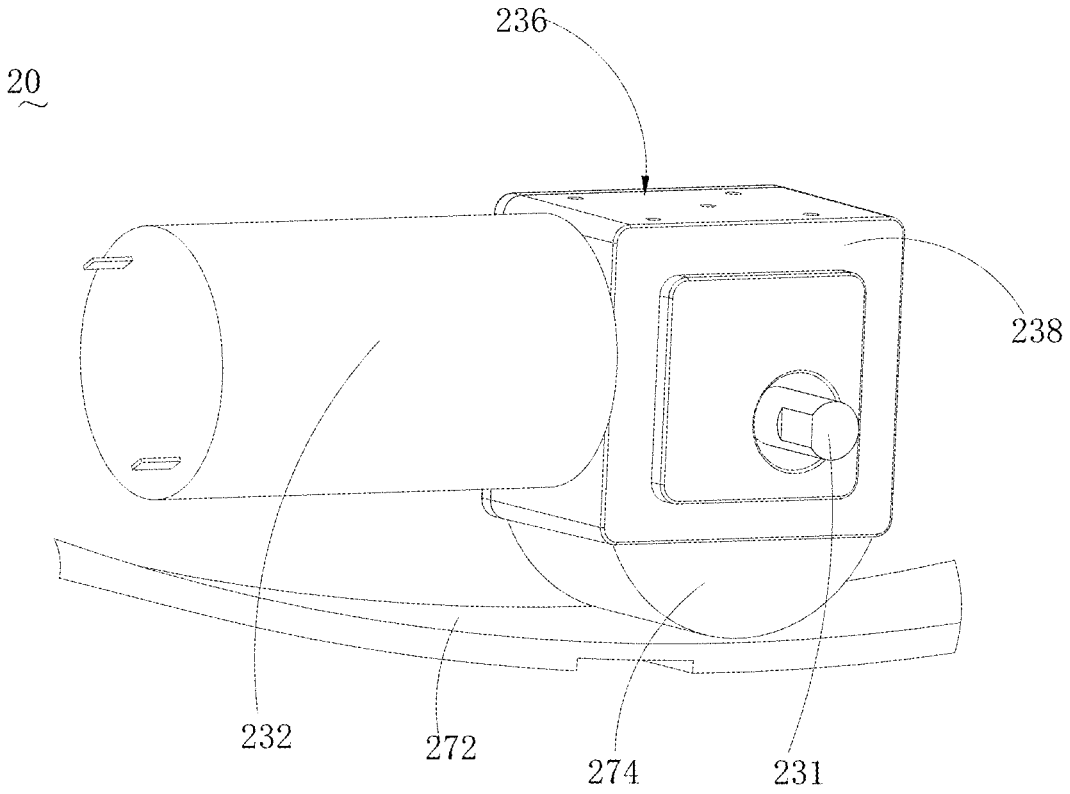
FIG. 13 is another schematic structural view illustrating the bearing structure according to an embodiment of the present disclosure.

In other embodiments, referring to FIG. 13, the bearing structure 27 may be an arc-shaped block with a predetermined curvature, such as a bearing structure 27 made of a smooth material such as POM, etc. The arc-shaped block may slide within the chamber 12 as the driving member 232 drives the rotation member 234 to drive the balancer 20 to move.

In some embodiments, referring to FIG. 14 to FIG. 18, the balance assembly 100 includes an identification member 40 and a displacement detection member 50. The balance assembly 100 is configured to cause a relative movement between the identification member 40 and the displacement detection member 50 in response to the driving assembly 23 driving the balancer 20 to move within the chamber 12. The displacement detection member 50 is configured to detect the number of times of the identification member 40 passing by the displacement detection member 50. The number of times of the identification member 40 passing by the displacement detection member 50 is related to the position of the balancer 20. In this way, the displacement detection member 50 can detect the number of times of the identification member 40 passing by the displacement detection member 50, and thus can obtain a movement distance of the balancer 20, so that the position of the balancer 20 can be determined.

It should be understood that in the embodiment of the present disclosure, when the balancer 20 moves within the chamber 12, the identification member 40 moves relative to the displacement detection member 50 and passes by the displacement detection member 50, and the number of times of the identification member 40 passing by the displacement detection member 50 is correlated with the position of the balancer 20. Therefore, the movement distance of the balancer 20 can be determined by detecting the number of times of the identification member 40 passing by the displacement detection member 50, and the position of the balancer 20 can be then determined in combination with an initial position 121 of the balancer 20. The initial position 121 may refer to a position of the balancer 20 before it begins to move within the chamber 12, or to a position that can be determined during the movement of the balancer 20.

In some embodiments, the identification member 40 may be disposed on the rotation member 234 or the inner wall 122 of the chamber 12. In this way, the identification member 40 can be determined in several manners, to improve a flexibility of the identification member 40 during its installation.

Figure 14:
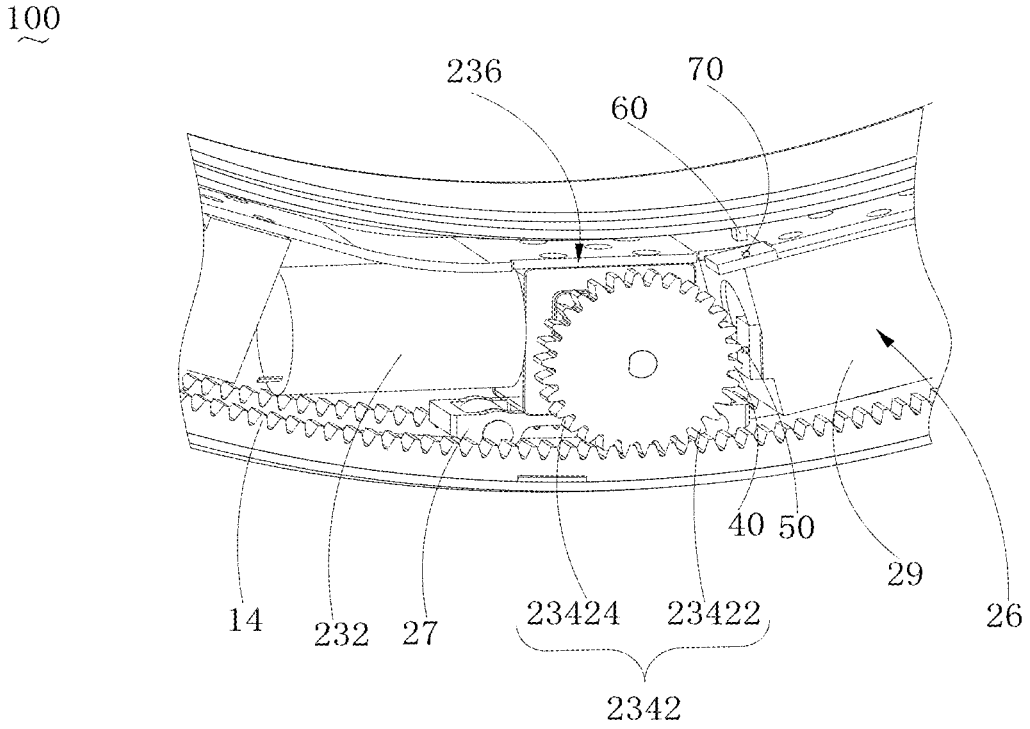
FIG. 14 is a schematic structural view illustrating a part of a balance assembly according to still another embodiment of the present disclosure.

Further, referring to FIG. 14, in the illustrated embodiment, the identification member 40 is disposed on the rotation member 234. In one embodiment, the rotation member 234 includes the gear 2342. The chamber 12 includes the inner wall 122. The inner wall 122 has the connection member 14 provided thereon. The gear 2342 is engaged with the tooth portion of the connection member 14. The identification member 40 is a tooth 23422 of the gear 2342 or a tooth of the tooth portion of the connection member 14. Thus, the tooth 23422 of the gear 2342 may be used as the identification member 40, and thus no additional identification member 40 is required. It should be understood that in other embodiments, the identification member 40 may also be a tooth of the tooth portion of the connection member 14.

A groove 23424 is formed between the teeth of the gear 2342 or the teeth portion of the connection member 14, and the tooth 23422 and the groove 23424 are evenly arrange in an alternating manner. The gear 2342 is engaged with and rotated relative to the tooth portion of the connection member 14. In response to the gear 2342 rotating, the balancer 20 can be driven to move relative to the connection member 14. In this case, the tooth 23422 of the gear 2342 or the tooth of the tooth portion of the connection member 14 may be used as the identification member 40, and correspondingly, the displacement detection member 50 can be mounted on the balancer 20. The displacement detection member 50 includes a detection surface facing towards the identification member 40. In a case where the tooth of the gear 2342 is used as the identification member 40, the identification member 40 is disposed on the rotation member 234. In a case where the tooth of the tooth portion of the connection member 14 disposed on the inner wall 122 is used as the identification member 40, the identification member 40 is disposed on the inner wall 122 of the chamber 12. In other embodiments, the identification member 40 may be disposed at another position within the chamber 12 other than the inner wall 122.

In one embodiment, when the identification member 40 is the tooth 23422 of the gear 2342, the displacement detection member 50 may be mounted at a position on the balancer 20 directly facing towards the tooth of the gear 2342. When the gear 2342 is rotated, the displacement detection member 50 is relatively stationary. When the identification member 40 is the tooth 23422 of the tooth portion of the connection member 14, the displacement detection member 50 may be mounted at a position on the balancer 20 directly facing towards the tooth of the tooth portion of the connection member 14. When the gear 2342 is rotated, the balancer 20 moves to drive the displacement detection member 50 to move relative to the connection member 14. During the rotation of the gear 2342, the tooth 23422 of the gear 2342 will continuously passes by the displacement detection member 50. Thus, the number of times of the tooth 23422 of the gear 2342 passing by the displacement detection member 50, i.e., the number of teeth of the gear 2342 passing by the displacement detection member 50, can be detected.

In some embodiments, the displacement detection member 50 includes at least one of a light sensor, a Hall sensor, and an ultrasonic sensor. In this way, the displacement detection member 50 is selectable and the cost is relatively low.

In one embodiment, when the displacement detection member 50 includes one kind of sensor, one of the light sensor, the Hall sensor, and the ultrasonic sensor may be selected. When the displacement detection member 50 includes multiple kinds of sensors, two or more of the light sensor, the Hall sensor, and the ultrasonic sensor may be selected. An average value of data detected by two or more sensors can be considered as an output data of the displacement detection member 50, or the data may be considered as the output data of the displacement detection member 50 after calculated with different weights or proportions.

It should be understood that with the development of technology, the manufacturing process of the light sensor, the Hall sensor, the ultrasonic sensor, etc. has become quite mature, which allows the sensor of the above-mentioned type can have smaller size and lower manufacturing cost, and can be mass-produced and adapted to be applied in the balance assembly 100. By selecting the sensor of the above-mentioned type for the displacement detection member 50, the detection of the identification member 40 can be realized, and the manufacturing cost of the balance assembly 100 can also be reduced.

Figure 15:
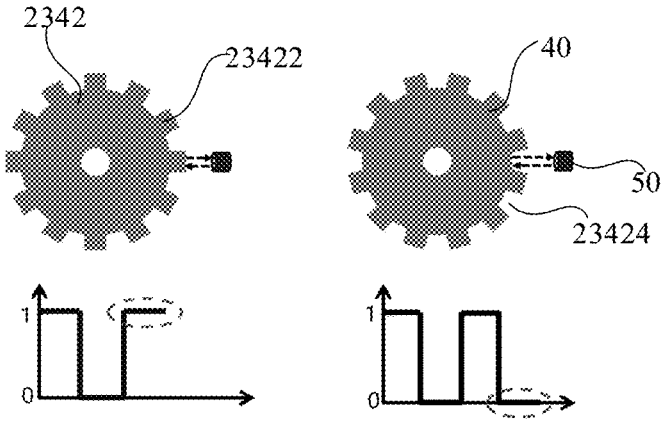
FIG. 15 and FIG. 16 are each a schematic view illustrating a detection of a displacement detection member according to an embodiment of the present disclosure.

In the embodiment shown in FIG. 15, the identification member 40 is the tooth 23422 of the gear 2342, and the displacement detection member 50 is the light sensor that may transmit and receiving a light signal. Since a distance between the tooth 23422 of the gear 2342 and the light sensor is different from a distance between the groove 23424 and the light sensor, an intensity of a light signal reflected by the tooth 23422 and received by the light sensor is different from an intensity of a light signal reflected by the groove 23424 and received by the light sensor. After processing, a regular pulse signal can be obtained, and the number of pulses is the number of teeth the gear 2342 rotates, to obtain the movement distance of the balancer 20. Then, combined with the initial position 121 of the balancer 20, the position of the balancer 20 can be obtained. The light sensor may be an infrared sensor. The ultrasonic sensor is similar to the light sensor in principle, which will be omitted and not be repeated herein.

Figure 16:
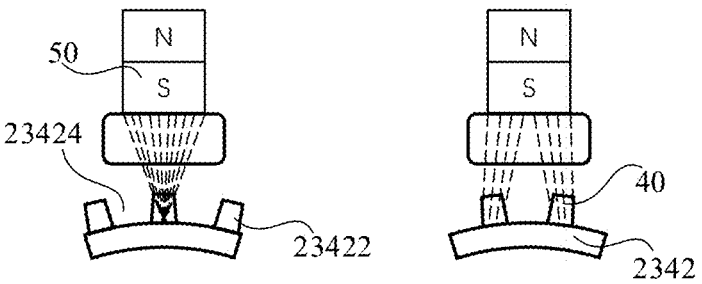

In the embodiment shown in FIG. 16, the identification member 40 is the tooth 23422 of the gear 2342, and the displacement detection member 50 is the Hall sensor. Since the tooth 23422 and the groove 23424 would affect a direction of magnetic lines of force of the Hall sensor, a density of the magnetic lines of force passing through the Hall sensor is changed. When the gear 2342 rotates, the Hall sensor outputs regular pulse signals. Based on the pulse signals, the number of teeth rotated by the gear 2342 can be calculated, to obtain the movement distance of the balancer 20. Then, combined with the initial position 121 of the balancer 20, the position of the balancer 20 can be obtained.

In other embodiments, the identification member 40 may be black-and-white stripes, and the displacement detection member 50 may be the light sensor. The black-and-white stripes may be provided on the gear 2342, or on a member rotating coaxially with the gear 2342, or on the inner wall 122 of the chamber 12 to form a circular ring and be arranged concentrically with the connection member 14. The light sensor may be mounted at a position on the balancer 20 directly facing towards the black-and-white stripes. Since the black stripe absorbs light and the white stripe reflects the light, the black-and-white stripes will continuously pass by the light sensor during the movement of the balancer 20. Thus, the number of times of the white stripe passing by the light sensor, i.e., the number of white stripes passing by the light sensor, can be detected. Regular pulse signals can be obtained based on the light signals received by the light sensor. The number of pulses is the number of white stripes by which the balancer 20 rotates. Since a width between the white stripe and the black stripe is determined, the movement distance of the balancer 20 can thus be obtained. Then, combined with the initial position 121 of the balancer 20, the position of the balancer 20 can be obtained.

It should be noted that the identification member 40 as described above may also have other configurations. For example, the rotation member 234 may be a wheel having spokes, and the identification member 40 may be the spokes of the wheel. The displacement detection member 50 can detect the number of times of the spokes passing by the displacement detection member 50. The specific detection principle is similar to the detection principle as described above.

Figure 17:
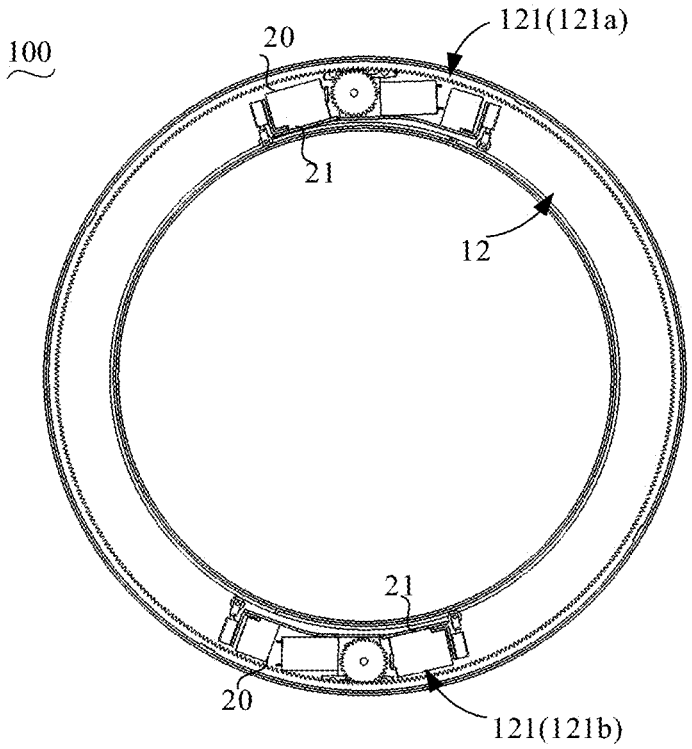
FIG. 17 is a schematic view illustrating the balancer in an initial position according to an embodiment of the present disclosure.
Figure 18:
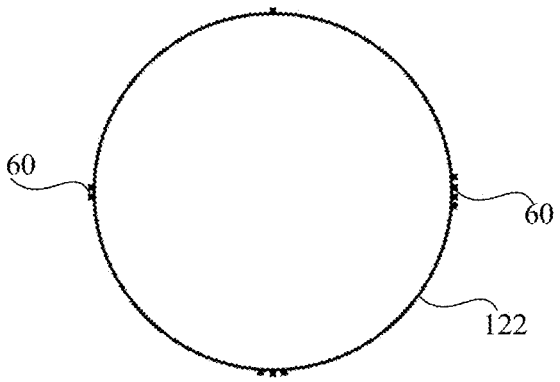
FIG. 18 is a schematic distributive view illustrating a correction member according to an embodiment of the present disclosure.

Referring to FIGS. 17 and 18, in some embodiments, the chamber 12 has an initial position 121. The balancer 20 includes the controller 21 electrically connected to the displacement detection member 50. The controller 21 is configured to determine the position of the balancer 20 based on the number of times of the identification member 40 passing by the displacement detection member 50 and the initial position 121. Thus, it is convenient to determine the position of the balancer 20.

It will be appreciated that, in a case where the balancer 20 does not move, the initial position 121 of the balancer 20 refers to a default position within the chamber 12 when the balancer 20 is stationary. The controller 21 records the initial position 121 and determines the position of the balancer 20 in combination with the distance by which the balancer 20 has moved when the balancer 20 begins to move from the default position. In one embodiment, the displacement detection member 50 outputs regular pulse signals based on the number of times of the identification member 40 passing by the displacement detection member 50. The controller 21 receives the pulse signals output from the displacement detection member 50, and the pulse signals are processed to obtain the movement distance of the balancer 20, and then finally calculate a specific position of the balancer 20 in combination with the initial position 121 of the balancer 20. The balancer 20 may include the control board 26 (not illustrated) on which the controller 21 may be disposed. The specific position of the balancer 20 may be transmitted to the main controller 400 of the household appliance 1000 in a wired or wireless manner.

In the embodiments of the present disclosure, initial positions 121 may be provided in the chamber 12. When the chamber 12 has balancers 20 provided therein, one balancer 20 remains at each initial position 121. In an embodiment, two initial positions 121 are provided within the chamber 12 and two balancers 20 are provided. When the two balancers 20 do not move, one balancer 20 remains stationary at each initial position 121. In one embodiment, the two initial positions 121 are arranged symmetrically. Thus, the balancing body 10 can be kept in balance without the movement of the balancer 20.

In the embodiment shown in FIG. 18, the chamber 12 has an initial position 121*a* and an initial position 121*b* provided therein. One balancer 20 remains at each of the initial position 121*a* and the initial position 121*b*. In other embodiments, two, or three, or other numbers of initial positions 121 may be provided, and the specific positions may be set as desired, which is not specifically limited herein.

Referring to FIG. 4 and FIG. 14, in some embodiments, the balance assembly 100 includes a correction member 60 and a correction detection member 70. The balance assembly 100 is configured to cause a relative movement between the correction member 60 and the correction detection member 70 during the movement of the balancer 20. The correction detection member 70 is configured to detect the correction member 60 to eliminate a position error of the balancer 20. In this way, an accuracy of the calculation of the movement distance of the balancer 20 can be improved.

It should be understood that since the balancer 20 moves for a long time, an accumulated error may occur when the displacement detection member 50 detects information on the number of times of the identification member 40 passing by the displacement detection member 50. Therefore, when calculating the movement distance of the balancer 20 by the errored information on the number of times, it would result in an error in the determined position of the balancer 20. Therefore, the error in the position of the balancer 20 can be eliminated by arranging the correction member 60 and the correction detection member 70.

In one embodiment, when the correction detection member 70 passes by each correction member 60, information on the correction member 60 detected by the correction detection member 70 is transmitted to the controller 21. Further, the controller 21 sets a position at which the balancer 20 is located as a value of 0, that is, an origin position, to recalculate the movement distance of the balancer 20, so that the position of the balancer 20 cannot be accurately determined due to an accumulated distance error caused by the long-term movement of the balancer 20. In the present embodiment, after the correction detection member 70 passes by each correction member 60, the information on the number of times of the displacement detection member 50 passing by the identification member 40 will be fed back to the controller 21 again by a pulse signal starting from 0. The controller 21 will start calculating the movement distance of the balancer 20 again and derive the accurate position information on the balancer 20 in the balancing body 10. In a case where two or more correction members 60 are provided, a distance between two adjacent correction members 60 is constant. When the balancer 20 sequentially passes by the two adjacent correction members 60, the distance by which the balancer 20 moves between the two correction members 60 can be obtained. Thus, the error generated by the displacement detection member 50 between the two adjacent correction members 60 can be eliminated.

In connection with FIG. 18, correction members 60 is provided. Correction members 60 is arranged at intervals on the inner wall 122, such as a second inner wall 122, of the chamber 12. Each of the correction member 60 includes a different number of correction portions. The correction detection member 70 may be one of a light sensor, an ultrasonic sensor, and a Hall sensor. The correction detection member 70 will trigger different pulse signals when passing by different number of correction portions. The number of pulses of the pulse signals is the same as the number of correction portions. In this way, it is possible to determine the correction member 60 by which the balancer 20 is passing based on the pulse signal output from the correction detection member 70, to determine the specific position of the balancer 20 within the chamber 12. In this way, the position of the balancer 20 within the chamber 12 can be determined. In one example, the inner wall 122 of the chamber 12 is provided with one correction member 60 at intervals, and one, two, three, and four correction portions may be provided.

When the correction detection member 70 includes the light sensor, the correction member 60 may be disposed on the second inner wall 122, and the correction portion may be black-and-white stripes. The light sensor may emit a light signal to the second inner wall 122 and receive the light signal reflected by the second inner wall 122. When the balancer 20 passes by the correction member 60, the light sensor passes by the black-and-white stripes, which causes an intensity of the received light signal to be changed, to output pulse signals corresponding to the correction portions in number. Based on the pulse signals, the number of the correction portions by which the balancer 20 passes can be determined, to determine a current position of the balancer 20 based on the position of the correction member 60. In other embodiments, the correction portion may also be a groove 23424. In one embodiment, the correction portion may be a protrusion. Pulse signals corresponding to the correction portions in number can also be obtained depending on the different intensity of the light signals received by the light sensor, so that the current position of the balancer 20 can be finally determined. The principle of the ultrasonic sensor is similar to that of light sensor, which will be omitted herein.

In a case where the correction detection member 70 includes the Hall sensor, the correction portion may be a protruding structure made of a metal material. It should understood that when the balancer 20 passes by the correction member 60, the correction member 60 will affect a direction of magnetic lines of force of the Hall sensor to change a density of the magnetic lines of force passing through the Hall sensor, so that the Hall sensor outputs pulse signals corresponding to the correction portion sin number. The number of the correction portions by which the balancer 20 passes can be determined based on the number of pulse signals, to determine the current position of the balancer 20 based on the position of the correction member 60.

It should be noted that the number and position of the correction members 60 as well as the number of correction portions of the correction member 60 can be adjusted as desired, which is not limited to the above-mentioned embodiments.

Referring to FIG. 1, an embodiment of the present disclosure provides a household appliance 1000 including: a body 300, a cavity 200 rotatably connected to the body 300; a second wireless charging assembly 36; and the balance assembly 100 according to any one of the embodiments as described above. The energy storage device 30, the first wireless charging assembly 34, and the balancing body 10 are mounted within the cavity 200, and the second wireless charging assembly 36 is mounted within the body 300.

In the above household appliance 1000, the first wireless charging assembly 34 may charge the energy storage device 30 with the charging energy wirelessly transmitted by the second wireless charging assembly 36. The energy storage device 30 of the balancer 20 in the balancing body 10 may receive the charging energy by the first conductive structure 11 and the second conductive structure 24. In this way, the power supply to the energy storage device 30 by a brush can be avoided, and a sealing performance of the balancing body 10 and a reliability of the power supply can be improved.

It should be understood that the household appliance 1000 may be a clothing treatment appliance such as a washing machine, a clothes dryer, or other household appliances 1000 having a rotatable cavity 200.

In one embodiment, the first wireless charging assembly 34 is mounted within the cavity 200 of the household appliance 1000, and the second wireless charging assembly 36 is mounted within the body 300 of the household appliance 1000. The second wireless charging assembly 36 may transmit charging energy to the first wireless charging assembly 34, and the first wireless charging assembly 34 may charge the energy storage device with the received charging energy.

In the illustrated embodiment, the household appliance 1000 is a washing machine, and the cavity 200 is rotatably located within the body 300 for washing laundry. The laundry is placed within the cavity 200. When the washing machine is operating (e.g., during a dehydration stage), the cavity 200 rotates at a high rotation speed, and the laundry inside the cavity 200 may be unevenly distributed, which may result in an eccentricity. When the cavity 200 rotates at the high rotation speed, the washing machine will generate a great vibration. The balancing body 10 is attached and fixed to the cavity 200 to rotate together with the cavity 200. Therefore, an eccentric mass of the cavity 200 as it rotates can be offset or reduced by the movement of the balancer 20 within the balancing body 10, which in turn can reduce the vibration of the washing machine.

In a case where the household appliance 1000 is the washing machine, the cavity 200 is a washing cavity 200 (an inner tub), the body 300 may include a housing and a water-receiving cavity 201 (an outer tub). Each of the water-receiving cavity 201 and the washing cavity 200 is cylindrical. The washing cavity 200 is rotatably disposed in the water-receiving cavity 201, and the water-receiving cavity 201 and the washing cavity 200 may be disposed in the housing. The energy storage device 30 may be disposed in the water-receiving cavity 201 or may be disposed in the body 300. The washing cavity 200 may have a rotation shaft 231 arranged horizontally, inclined or vertically. That is, the rotation shaft 231 of the washing cavity 200 is parallel, inclined, or perpendicular to a horizontal plane. It should be understood that one or more balancing bodies 10 may be arranged at any position of the washing cavity 200, and the balancing body 10 is rotated with the rotation of the washing cavity 200. The balancing body 10 has a central axis parallel to or coincident with a rotation axis X of the washing cavity 200. That is, the balancing body 10 may be arranged coaxially with the washing cavity 200 or eccentrically with respect to the washing cavity 200. The balancing body 10 may also be arranged in a spiral shape on the cavity 200.

Referring to FIG. 19, the household appliance 1000 is the washing machine. The cavity 200 includes a first end 202 and a second end 204 along the rotation axis X. Two balancing bodies 10 may be provided and are connected to the first end 202 and the second end 204, respectively. Each balancing body 10 has at least one balancer 20, such as one or two or more than two, provided therein. In one embodiment, two balancers 20 are arranged in the balancing body 10. In this way, the eccentric mass of the cavity 200 is balanced by controlling the movement of the balancer 20 during the operation of the washing machine.

In one embodiment, the second end 204 of the cavity 200 is fixedly connected to a fixing frame 700, which may be connected to a rotation shaft (not illustrated). A power unit of the household appliance 1000 may be connected to the rotation shaft to drive the cavity 200 to rotate. In the illustrated embodiment, the first end 202 of the cavity 200 is threaded with another balancing body 10. The first end 202 of the cavity 200 is a front end, and the second end 204 is a rear end. The front end may refer to an end facing towards a user. In other embodiments, the balancing body 10 is disposed at the first end 202 or the second end 204 of the cavity 200, or the balancing body 10 is disposed between the first end 202 and the second end 204. In the illustrated embodiment, two balancers 20 are arranged within the balancing body 10. It should to be noted that in the present disclosure, the two balancers 20 within the balancing body 10 has initial positions 121 symmetrically arranged in such a manner that the cavity 200 can be balanced in an unloaded state.

Figure 20:
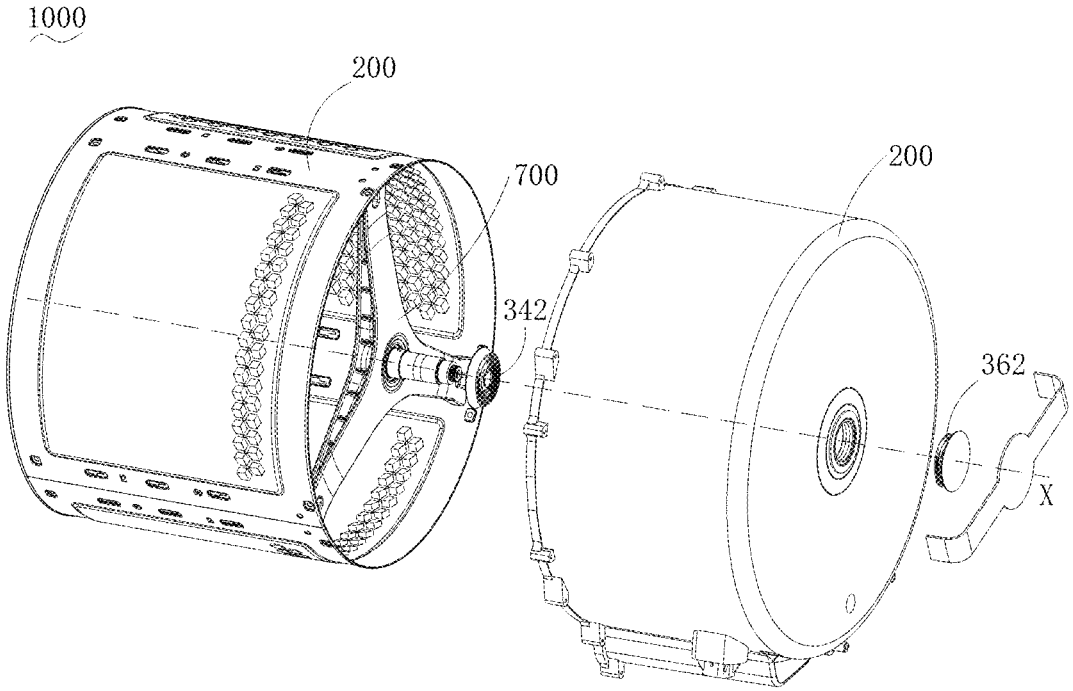
FIG. 20 is another schematic partially exploded view illustrating a cavity and a balancing body according to an embodiment of the present disclosure.

It will be understood that, referring to FIG. 20, the receiving coil 342 is mounted on the fixing frame 700 of the washing cavity 200. The transmitting coil 362 is mounted at an end of the water-receiving cavity 201.

In one embodiment, a central axis of each of the receiving coil 342 and the transmitting coil 362 is co-linear with the rotation axis X of the cavity 200. The receiving coil 342 is opposite to and spaced apart from the transmitting coil 362. Each of the receiving coil 342 and the transmitting coil 362 may be an electromagnetic coil. The transmitting coil 362 may transmit an electromagnetic wave energy, and the receiving coil 342 may receive the electromagnetic wave energy. A current generated by the receiving coil 342 through the electromagnetic induction will be inputted through wires inside the fixing frame 700 to a component of the cavity to be powered, such as the energy storage device 30.

Also, in connection with FIG. 1, in order to further reduce the transmission of vibration from an interior to an exterior of the household appliance 1000, the water-receiving cavity 201 may be connected to a mounting plate 600 by a vibration damping structure 500. The mounting plate 600 may be fixed to a bottom plate of the housing of the household appliance 1000. The vibration damping structure 500 may use a spring, a hydraulic member, and other structural members to reduce the transmission of vibration.

In the description of this specification, descriptions with reference to the terms "an embodiment", "some embodiments", "illustrative embodiments", "an example", "a specific example", "some examples", etc., mean that specific features, structure, materials, or characteristics described in conjunction with the embodiment or example are included in at least one embodiment or example of the present disclosure. In this specification, the schematic representations of the above terms do not necessarily refer to the same embodiment or example. In one embodiment, the described specific features, structures, materials or characteristics may be combined in any one or more embodiments or examples in a suitable manner.

What is claimed is:

1. A balance assembly, applied in a household appliance, the balance assembly comprising:

a balancing body having a chamber defined therein;

a balancer movably located in the chamber;

a first wireless charging assembly; and an energy storage device located outside the balancer and connected to the first wireless charging assembly, wherein the energy storage device, the first wireless charging assembly, and the balancing body are mounted within a cavity of the household appliance, wherein the first wireless charging assembly is configured to receive a charging energy wirelessly transmitted by the household appliance and charge the energy storage device with the charging energy, wherein the chamber comprises a first conductive structure provided on an inner wall thereof, the first conductive structure being electrically connected to the energy storage device, wherein the balancer comprises a second conductive structure movably connected to the first conductive structure, and wherein the energy storage device supplies power to the balancer by the first conductive structure and the second conductive structure.

2. The balance assembly according to claim 1, wherein the balancer comprises a control board, wherein the second conductive structure comprises a first conductive element and a second conductive element, and wherein the first conductive structure comprises a first guide rail and a second guide rail, the first conductive element being connected to the first guide rail, the second conductive element being connected to the second guide rail, and the first conductive element and the second conductive element being both electrically connected to the control board, respectively.

3. The balance assembly according to claim 2, wherein each of the first conductive element and the second conductive element comprises a conductive wheel, the conductive wheel of the first conductive element being movably connected to the first guide rail, and the conductive wheel of the second conductive element being movably connected to the second guide rail.

4. The balance assembly according to claim 3, wherein each of the first conductive element and the second conductive element comprises two conductive wheels and a connection rod, the two conductive wheels of the first conductive element being connected to each other by the connection rod of the first conductive element, the two conductive wheels of the second conductive element being connected to each other by the connection rod of the second conductive element, wherein the first guide rail is partially located within a space between the two conductive wheels of the first conductive element, and the second guide rail is partially located within a space between the two conductive wheels of the second conductive element.

5. The balance assembly according to claim 3, wherein the conductive wheel of the first conductive element is elastically abutted against the first guide rail, and wherein the conductive wheel of the second conductive element is elastically abutted against the second guide rail.

6. The balance assembly according to claim 5, wherein the second conductive structure further comprises a base, and a connection frame movably connected to the base, and wherein the first conductive element and the second conductive element are mounted on the connection frame.

7. The balance assembly according to claim 6, wherein the base has an elastic member provided therein, the elastic member being connected to the connection frame and configured to provide the connection frame with a force for elastically abutting the conductive wheel of the first conductive element against the first guide rail and for elastically abutting the conductive wheel of the second conductive element against the second guide rail.

8. The balance assembly according to claim 2, wherein the balancer further comprises a driving assembly, the driving assembly comprises a rotation member and a driving member connected to the rotation member and the control board, and the control board is configured to control the driving member to drive rotation of the rotation member and drive the balancer to move within the chamber.

9. The balance assembly according to claim 8, wherein the chamber has an annular connection member provided therein, the annular connection member having a tooth portion provided on an inner side thereof, and wherein the rotation member comprises a gear engaged with the tooth portion.

10. The balance assembly according to claim 8, wherein the driving assembly further comprises a speed regulating structure, and wherein the driving member and the rotation member are connected by the speed regulating structure.

11. The balance assembly according to claim 8, wherein the balancer further comprises a bearing structure, and wherein the driving assembly is disposed on the bearing structure, wherein the bearing structure is in contact with the inner wall of the chamber and configured to bear a centrifugal force during a movement of the balancer in the chamber by moving along the inner wall of the chamber during the movement of the balancer.

12. The balance assembly according to claim 8, further comprising:

an identification member; and a displacement detection member configured to detect a number of times of the identification member passing by the displacement detection member, wherein the number of times of the identification member passing by the displacement detection member is related to a position of the balancer, and wherein the balance assembly is configured to, in response to the driving assembly driving the balancer to move within the chamber, cause a relative movement between the identification member and the displacement detection member.

13. The balance assembly according to claim 8, further comprising:

a correction member; and a correction detection member configured to detect the correction member to eliminate a position error of the balancer, wherein the balance assembly is configured to, during movement of the balancer, cause a relative movement between the correction member and the correction detection member.

14. A household appliance, comprising:

a main body;

a cavity rotatably connected to the main body;

a second wireless charging assembly; and a balance assembly, applied in the household appliance, the balance assembly comprising:

a balancing body having a chamber defined therein;

a balancer movably located in the chamber;

a first wireless charging assembly; and an energy storage device located outside the balancer and connected to the first wireless charging assembly, wherein the energy storage device, the first wireless charging assembly, and the balancing body are mounted within the cavity of the household appliance;

wherein the first wireless charging assembly is configured to receive a charging energy wirelessly transmitted by the household appliance and charge the energy storage device with the charging energy, wherein the chamber comprises a first conductive structure provided on an inner wall thereof, the first conductive structure being electrically connected to the energy storage device, wherein the balancer comprises a second conductive structure movably connected to the first conductive structure, wherein the energy storage device supplies power to the balancer by the first conductive structure and the second conductive structure, and wherein the energy storage device, the first wireless charging assembly, and the balancing body are mounted within the cavity, and wherein the second wireless charging assembly is mounted within the main body.

15. The household appliance according to claim 14, further comprising a main controller, wherein the balancer further comprises a controller in communication with the main controller.

16. The household appliance according to claim 14, wherein the first wireless charging assembly comprises a receiving coil, and wherein the second wireless charging assembly comprises a transmitting coil, the receiving coil and the transmitting coil being opposite to and spaced apart from each other.

17. The household appliance according to claim 16, wherein the receiving coil is arranged coaxially with the transmitting coil.

18. The household appliance according to claim 14, wherein the cavity is a washing cavity, wherein the main body comprises a housing and a water-receiving cavity, the washing cavity being rotatably disposed in the water-receiving cavity, and the water-receiving cavity and the washing cavity being arranged in the housing.

19. The household appliance according to claim 18, wherein the balancing body has a central axis parallel to or coincident with a rotation axis of the washing cavity.

20. The household appliance according to claim 14, wherein the household appliance is a washing machine.

* * * * *